US009140041B2

(12) United States Patent
Wollacott et al.

(10) Patent No.: US 9,140,041 B2
(45) Date of Patent: Sep. 22, 2015

(54) COMPRESSION LATCH

(75) Inventors: Martin Wollacott, Redditch (GB); Michael Leslie, Redditch (GB); Mark Jeffries, Cumming, GA (US)

(73) Assignee: Weston Body Hardware Limited, Redditch (BG)

( * ) Notice: Subject to any disclaimer, the term of this patent is extended or adjusted under 35 U.S.C. 154(b) by 404 days.

(21) Appl. No.: 13/606,194

(22) Filed: Sep. 7, 2012

(65) Prior Publication Data

US 2013/0328331 A1 Dec. 12, 2013

(30) Foreign Application Priority Data

Jun. 8, 2012 (GB) ..... 1210157.2

(51) Int. Cl.

| | |
|---|---|
| ***E05C 3/04*** | (2006.01) |
| ***E05C 3/00*** | (2006.01) |
| ***E05C 3/08*** | (2006.01) |
| ***E05C 9/08*** | (2006.01) |
| ***E05C 9/18*** | (2006.01) |
| ***E05B 17/00*** | (2006.01) |

(Continued)

(52) U.S. Cl.

CPC ..... *E05C 3/006* (2013.01); *E05B 17/0025* (2013.01); *E05C 3/08* (2013.01); *E05C 9/08* (2013.01); *E05C 9/1875* (2013.01); *E05B 5/00* (2013.01); *E05B 13/002* (2013.01); *E05B 63/06* (2013.01); *Y10T 292/1075* (2015.04); *Y10T 292/1083* (2015.04)

(58) Field of Classification Search

CPC ..... Y10S 292/31
USPC ..... 292/200, 202, 256.69, DIG. 31, DIG. 49
See application file for complete search history.

(56) References Cited

U.S. PATENT DOCUMENTS 1,071,862 A * 9/1913 Becker ..... 292/220
1,117,643 A * 11/1914 Dommer ..... 292/46

(Continued)

FOREIGN PATENT DOCUMENTS

EP 0259108 A1 3/1988
FR 1201284 * 12/1959

(Continued)

OTHER PUBLICATIONS

The Intellectual Property Office, Search Report for Application No. GB1210157.2, dated Oct. 25, 2012, 2 pages, United Kingdom.

(Continued)

*Primary Examiner* — Carlos Lugo
(74) *Attorney, Agent, or Firm* — Alston & Bird LLP

(57) ABSTRACT

A compression latch comprising a housing, a handle, and a latch member is provided. The housing has an inboard and an outboard side, and defines a plane substantially parallel to a closure plane. The handle is pivotably connected to the housing at a handle pivot point having a longitudinal axis substantially parallel to the plane, and the latch member is pivotably connected to the housing through a latch member pivot point, which is remote and inboard from the handle pivot point and also has a longitudinal axis substantially parallel to that of the handle pivot point. The latch member is pivotable about the latch member pivot point between an open and a closed position. The handle is connected to the latch member by a first linkage so the latch member is moveable between the open and closed positions by angular movement of the handle about the handle pivot point.

17 Claims, 22 Drawing Sheets

(51) Int. Cl.

| | |
|---|---|
| *E05C 3/06* | (2006.01) |
| *E05B 63/06* | (2006.01) |
| *E05B 5/00* | (2006.01) |
| *E05B 13/00* | (2006.01) |

(56) References Cited

U.S. PATENT DOCUMENTS

| | | | | | |
|---|---|---|---|---|---|
| 1,222,396 | A | * | 4/1917 | Hagstrom | 292/332 |
| 2,655,027 | A | * | 10/1953 | Lynxwiler | 70/208 |
| 2,750,217 | A | * | 6/1956 | Landholt | 292/97 |
| 2,927,812 | A | * | 3/1960 | Smith et al. | 292/196 |
| 3,214,207 | A | | 10/1965 | Swanson | |
| 3,993,338 | A | * | 11/1976 | Cherbourg et al. | 292/336.3 |
| 4,114,424 | A | | 9/1978 | Johnson | |
| 4,159,137 | A | | 6/1979 | Richter | |
| 4,318,557 | A | * | 3/1982 | Bourne et al. | 292/113 |
| 4,372,591 | A | | 2/1983 | Cook et al. | |
| 4,413,849 | A | * | 11/1983 | Davis et al. | 292/229 |
| 4,487,440 | A | | 12/1984 | Beijer | |
| 4,693,503 | A | * | 9/1987 | Bisbing | 292/210 |
| 4,858,970 | A | * | 8/1989 | Tedesco et al. | 292/113 |
| 4,911,485 | A | | 3/1990 | Wasilewski | |
| 4,925,221 | A | * | 5/1990 | Carmody et al. | 292/200 |
| 5,064,228 | A | | 11/1991 | Bisbing | |
| 5,257,839 | A | * | 11/1993 | Nielsen et al. | 292/113 |
| 5,409,272 | A | * | 4/1995 | McCormack | 292/66 |
| 5,462,318 | A | * | 10/1995 | Cooke | 292/200 |
| 5,638,709 | A | * | 6/1997 | Clavin | 70/208 |
| 6,179,350 | B1 | * | 1/2001 | Ely et al. | 292/113 |
| 6,530,250 | B1 | * | 3/2003 | Linares et al. | 70/208 |
| 6,532,778 | B2 | * | 3/2003 | Molzer et al. | 70/208 |
| 7,398,664 | B1 | * | 7/2008 | Weinerman et al. | 70/208 |
| 7,454,933 | B1 | * | 11/2008 | Paige et al. | 70/208 |
| 7,752,877 | B2 | * | 7/2010 | Burns | 70/208 |
| 8,857,230 | B1 | * | 10/2014 | Misner | 70/208 |
| 8,915,105 | B2 | * | 12/2014 | Weinerman et al. | 70/208 |
| 2005/0087996 | A1 | | 4/2005 | Jackson et al. | |
| 2011/0101710 | A1 | * | 5/2011 | Elbrecht et al. | 292/202 |
| 2013/0106122 | A1 | * | 5/2013 | Do et al. | 292/228 |
| 2014/0333074 | A1 | * | 11/2014 | Wollacott et al. | 292/202 |

FOREIGN PATENT DOCUMENTS

| | | | |
|---|---|---|---|
| GB | 1575252 | A | 9/1980 |
| GB | 2189539 | A | 10/1987 |
| GB | 2192927 | A | 1/1988 |
| GB | 2199363 | A | 7/1988 |
| GB | 2229761 | A | 10/1990 |
| GB | 2249807 | A | 5/1992 |
| GB | 2264530 | A | 9/1993 |
| WO | WO 88/01332 | A1 | 2/1988 |

OTHER PUBLICATIONS

The Intellectual Property Office, Combined Search and Examination Report for Application No. GB1210157.2, dated Oct. 26, 2012, 3 pages, United Kingdom.

* cited by examiner

COMPRESSION LATCH

CROSS-REFERENCE TO RELATED APPLICATIONS

This application claims priority to Great Britain Application No. 1210157.2, filed Jun. 8, 2012, the contents of which are further hereby incorporated by reference.

BACKGROUND OF THE INVENTION

1. Technical Field

The present invention relates to a compression latch for a closure.

2. Description of the Prior Art

It is known to use compression latches in a variety of applications, for example when force is required to hold a closure in place, or when sealing of a closure (e.g. a door, window or access panel of a vehicle or an item of construction plant) is needed. Compression latches often incorporate a pivoting latch arm held against a closure surround by latch mechanism, and biased into an open position by a spring or other resiliently biased device. The latch mechanism holds the latch arm in a closed position so that pressure is applied by the latch to a closure to keep it shut and/or seal it. Upon release of the latch mechanism, the resilient biasing device causes the latch arm to pivot open enabling the associated closure to be opened. Compression latches are typically mounted in an aperture cut from the sheet metal material of the closure.

There can be difficulties with existing compression latches of this type. The latch arm must clear the closure surround when the latch is in a fully open position, so that it does not prevent the closure from being fully opened. Considerable force may be required to close a latch, particularly where the latch is required to seal a closure. It is known to increase the length of the lever handle to allow a greater amount of mechanical advantage to be applied to the latch arm whilst limiting the force required at the handle, but this leads to increased space requirement, and for a requirement for a larger aperture to be cut in the closure. In addition, the level of mechanical advantage is fixed throughout the range of motion of the lever.

Where the closure is relatively large, it may be desirable for additional "satellite" compression latches to be connected to the main latch, and operated from it, in order to provide optimal retention. One way in which this may be achieved is to utilise the pivot point of the main latch as a "power take-off" for shafts to connect the satellite latches. However, the location of this pivot point on known latches is too close to the face of the closure for the shafts to be able to rotate freely.

A known latch of this type is disclosed in GB2264530 (Southco). It is not possible to alter the relative motion of the handle and the latch arm of the latch disclosed in GB2264530. The only way to vary the mechanical advantage of that latch is to vary the length of the handle and the latch arm. In addition, the pivot point is too close to the closure face to act as a power take-off.

The present invention seeks to overcome, or at least mitigate, the problems of the prior art.

SUMMARY OF THE INVENTION

According to the present invention there is provided a compression latch for a closure, comprising a housing, a handle and a latch member having a first end and a second end; wherein the housing has an inboard side and an outboard side, and defines a plane substantially parallel to a plane of said closure; the handle is pivotably connected to the housing at a handle pivot point, the handle pivot point having a longitudinal axis substantially parallel to said plane; the latch member first end is pivotably connected to the housing through a latch member pivot point remote from the handle pivot point and inboard thereof, the latch member pivot point having a longitudinal axis substantially parallel to the handle pivot point longitudinal axis; the latch member being pivotable about the latch member pivot point between an open position and a closed position; the handle is connected to the latch member by a first linkage such that the latch member is moveable between said open position and said closed position by angular movement of the handle about the handle pivot point; and the latch member comprises a striker at its second end.

The advantage provided by the above compression latch is that, due to separation of the handle and latch member pivot points, the resultant force applied by the latch member at a given region of its motion may be adjusted or tuned for a given input, improving ease of latch closure or for other ends.

The handle pivot point may be on the outboard side of the housing, and/or the latch member pivot point may be on the inboard side of the housing. The inboard side of the housing may be configured to be sealed from the outboard side of the housing. The handle pivot point may include a drive shaft extending between the inboard and outboard sides of the housing, and the first linkage may be connected to the drive shaft.

The first linkage may be configured such that angular movement of the handle about the handle pivot point results in smaller angular movement of the latch member at at least one position throughout its range of motion. The ratio of the angular movement of the handle to that of the latch member may vary depending upon the angular position of the latch member. The latch member may move through at least two zones, including an active zone adjacent the closed position, between the closed position and the open position, and the ratio of the angular movement of the handle may be greater in the active zone compared to outside the active zone. The ratio of the angular movement of the handle to that of the latch member may be between 1.1 and 1.5 when the latch member is within the active zone, and the ratio of the angular movement of the handle to that of the latch member may be between 1.2 and 1.4 when the latch member is within the active zone.

The latch member may be resiliently biased towards the open position, or may be resiliently biased towards the closed position.

The latch member may be pivotably connected to the housing by a second linkage, which may comprise first and second connection members pivotably connected between the latch member and the housing. The first and second connection members may form a parallelogram linkage with the housing and the latch member, and wherein motion of the parallelogram linkage may be controlled by the first linkage.

The first linkage may be at least a four-bar linkage, which may comprise a first link pivotably connected to the handle pivot point, and a second link pivotably connected to the first link at a linkage pivot point and pivotably connected to the latch member at a second link pivot point. The linkage pivot point may be inboard relative to the latch member. The first linkage may use over-centre motion to move between the closed position and an open position.

The handle pivot point may be between the latch member pivot point and the striker in a direction substantially parallel to the plane.

The first linkage may be a four-bar linkage. The linkage pivot point may be outboard relative to the latch member.

Where the latch member is resiliently biased towards the open position, the first linkage may retain the latch member in a lost motion arrangement such that movement of the latch member towards the open position is controlled by the first linkage. The latch pivot point may be translatable with respect to the housing. The housing may define a guide track along which the latch pivot point is slidable. The guide track may include a dogleg configured to receive the latch pivot point as the closed position is approached.

Alternatively, the first linkage may be translatably connected to the latch member, and the shaft member may define a guide track along which an end of the first linkage is slidable, which may be curved. The guide track may include a dogleg configured to receive said end of the first linkage as the closed position is approached.

The handle pivot point may be fixed in relation to the latch member pivot point. The latch member pivot point may be inboard of the handle pivot point, and/or the handle pivot point may be between the latch member pivot point and the striker in a direction substantially parallel to the plane.

There is further provided a compression latch for a closure, comprising a housing, a handle and a latch member having a first end and a second end. The housing has an inboard side and an outboard side, and defines a plane substantially parallel to a plane of said closure. The handle is pivotably connected to the housing at a handle pivot point, the handle pivot point having a longitudinal axis substantially parallel to said plane. The handle is connected to the latch member by a first linkage. The latch member first end is pivotably connected to the housing by a second linkage. The latch member is movable in relation to the housing between an open position and a closed position; such that the latch member is moveable between said open position and said closed position by angular movement of the handle about the handle pivot point. The latch member comprises a striker at its second end.

The latch member may be pivotably connected to the housing by a second linkage, which may comprise first and second connection members pivotably connected between the latch member and the housing. The first and second connection members may form a parallelogram linkage with the housing and the latch member, and wherein motion of the parallelogram linkage may be controlled by the first linkage.

The second linkage may comprise first and second connection members pivotably connected between the latch member and the housing. The first and second connection members may form a parallelogram linkage with the housing and the latch member, and motion of the parallelogram linkage may be controlled by the first linkage.

The first linkage may comprise a first link pivotably connected to the handle pivot point, and a second link pivotably connected to the first link at a linkage pivot point and pivotably connected to the latch member at a second link pivot point.

The latch member may be cranked away from the housing when in the closed position. The striker may be adjustable. The compression latch may further comprise a latching mechanism configured to retain the latch when the latch member is in the closed position, and/or may further comprise a lock, and/or a padlock loop. The padlock loop may extend through an aperture defined by the handle therefor. The latch member pivot point may include a non-circular projection configured for the attachment of an extension shaft arranged to rotate with the latch member.

There may further be provided a compression latch assembly incorporating a compression latch as described above, which may further comprise at least one additional latch member pivotable about a fifth pivot point remote to the latch member pivot point, configured such that the at least one additional latch member is actuated by movement of the latch member of the compression latch.

BRIEF DESCRIPTION OF THE DRAWINGS

A compression latch will now be described in detail by way of example and with reference to the accompanying drawings in which:

FIG. 3 is a side view of a compression latch according to the embodiment of FIGS. 1 and 2;

DETAILED DESCRIPTION OF VARIOUS EMBODIMENTS

Figure 1:
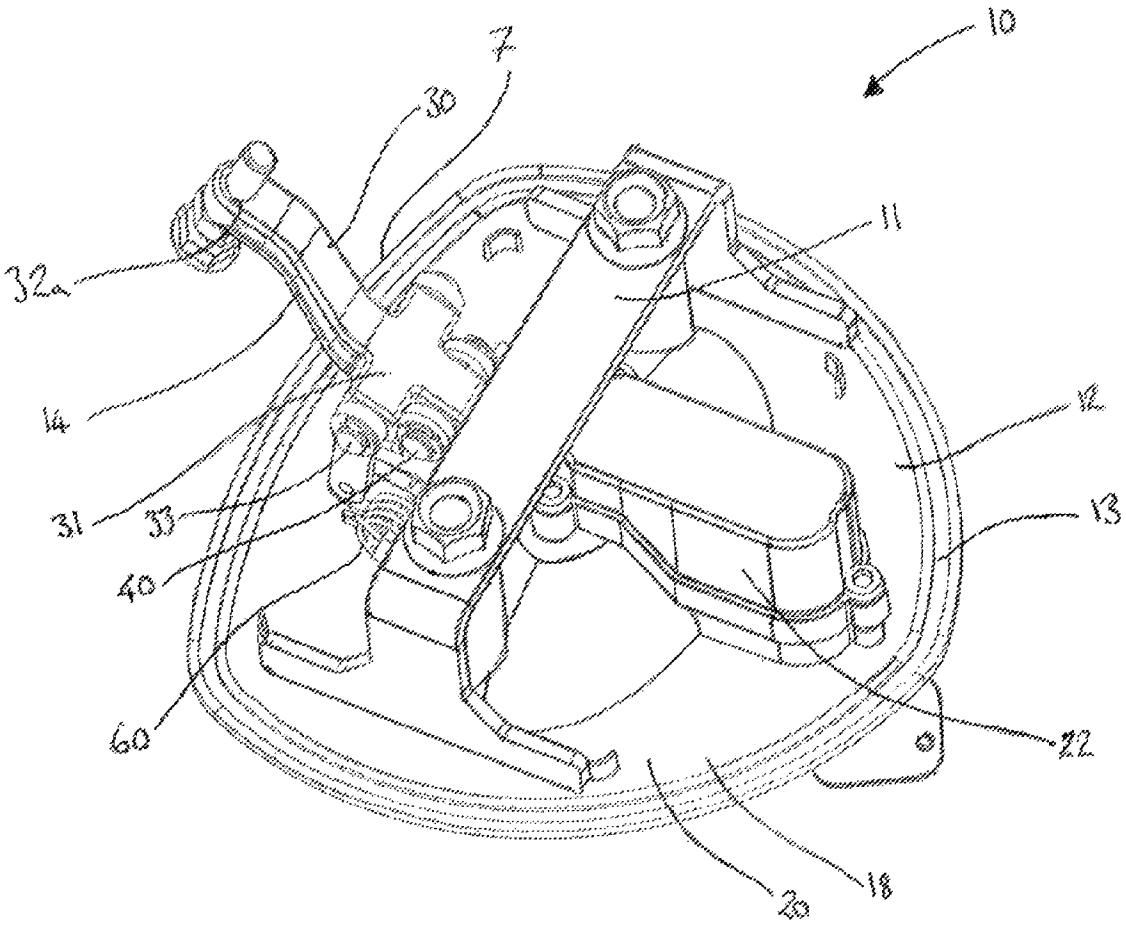
FIG. 1 is a perspective view of a compression latch according to a first embodiment of the present invention in a partially open position.
Figure 2:
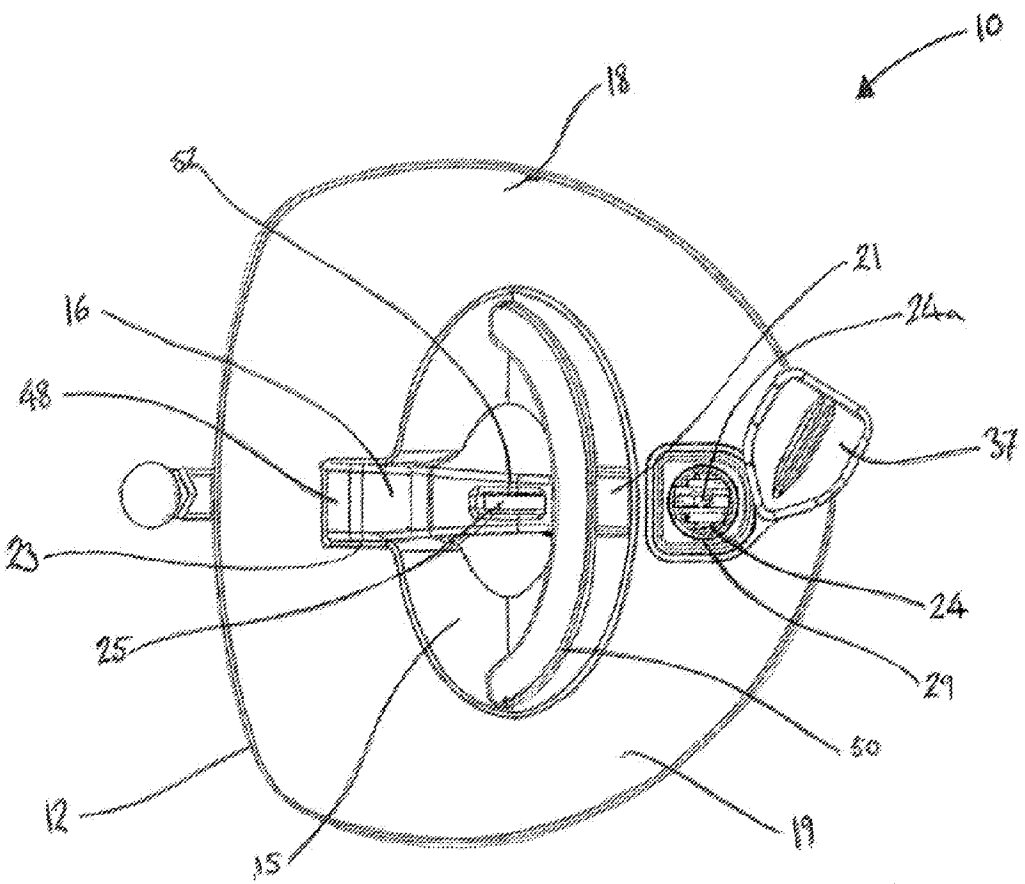
FIG. 2 is a plan view of a compression latch according to the embodiment of FIG. 1.

Referring to FIGS. 1 to 3, a compression latch according to an embodiment of the present invention is generally indicated at 10. The latch 10 has a housing 12, a first latch member 14 and a handle 16. The latch 10 is moveable between a closed position, in which the latch member 14 is actuated to apply pressure to a closure surround 8, and a fully open position, where the latch member is clear of the closure surround. The latch 10 is shown in FIGS. 1 to 3 in a partially open position.

The housing 12 defines an outboard side 19 and an inboard side 20, and includes a main body 18. The housing has a first edge 7 intended to be mounted proximal a free edge of a closure 9 (i.e. the edge over which the latch member extends). The inboard side 20 is substantially sealed from the outboard side 19 to inhibit the ingress of water through the latch 10.

The housing body 18 has at its inboard side a peripheral channel configured to receive a gasket (not shown), allowing the housing 12 to be sealed against the closure 9. When installed in the closure 9 the housing 12 is held in place by a bracket 11. The channel defines a housing body plane coincident with the plane of the closure in which the latch 10 is installed.

The housing 12 has in its outboard side 19 a shallow recess 15, and a handle recess 21 off the recess 15, with walls 22 extending inboard 20, substantially normal to the plane. The recesses 15, 21 are configured to receive the handle 16 when the latch 10 is in a closed position. The shallow recess 15 is generally oval shaped and has space to allow the handle 16 to be grasped easily when the latch 10 is in the closed position.

The walls 22 define a pivot mounting point 23 for the handle 16 in the form of two co-axial circular apertures (not shown) in the side walls 22. The inboard side 20 of the housing 12 includes a latch member mounting point 26 in the form of circular apertures in two parallel protrusions 28 extending inboard of the housing 12.

In this embodiment the housing 12 is of 30% glass-filled nylon. Alternative materials may be used, for example other injection-moulded plastics or injection-moulded metal.

The handle 16 has a handle arm 44 having a free end 46 and a connection end 48. The free end 46 is in this embodiment substantially T-shaped, having a curved bar 50 perpendicular to the remainder of the arm 44 for ease of use. The handle arm 44 defines a padlock loop aperture 52 through which a padlock loop 25 extending outboard from the handle recess 21 extends when the handle 16 is in the closed position, allowing a padlock (not shown) to be clipped through the loop 52. The handle connection end 48 defines a bore (not shown).

The handle 16 is pivotably connected to the outboard side 19 of the housing 12 by a handle shaft 54 (see FIG. 5) that passes through the handle bore and the apertures of the handle mounting point 23 to form a handle pivot point 56. The handle pivot point 56 has a longitudinal axis V substantially parallel to the plane of the housing body 18. The handle shaft 54 has an interference fit (e.g. by virtue of a grub screw or roll pin) in the handle bore and so turns with the handle 16.

Figure 5:
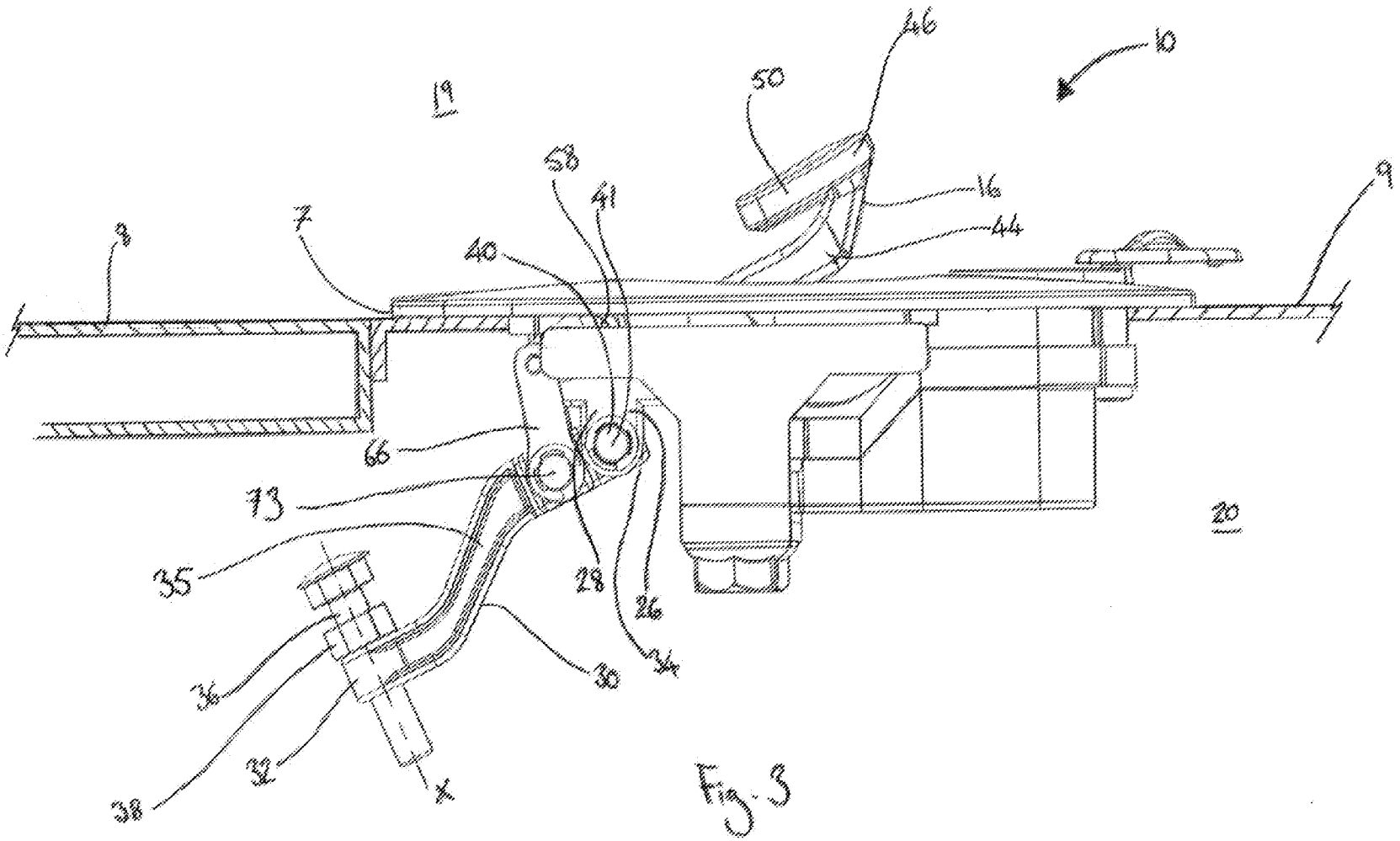
FIG. 5 is a partial perspective view showing part of the compression latch according to the embodiment of FIGS. 1 to 4 in more detail.
Figure 4:
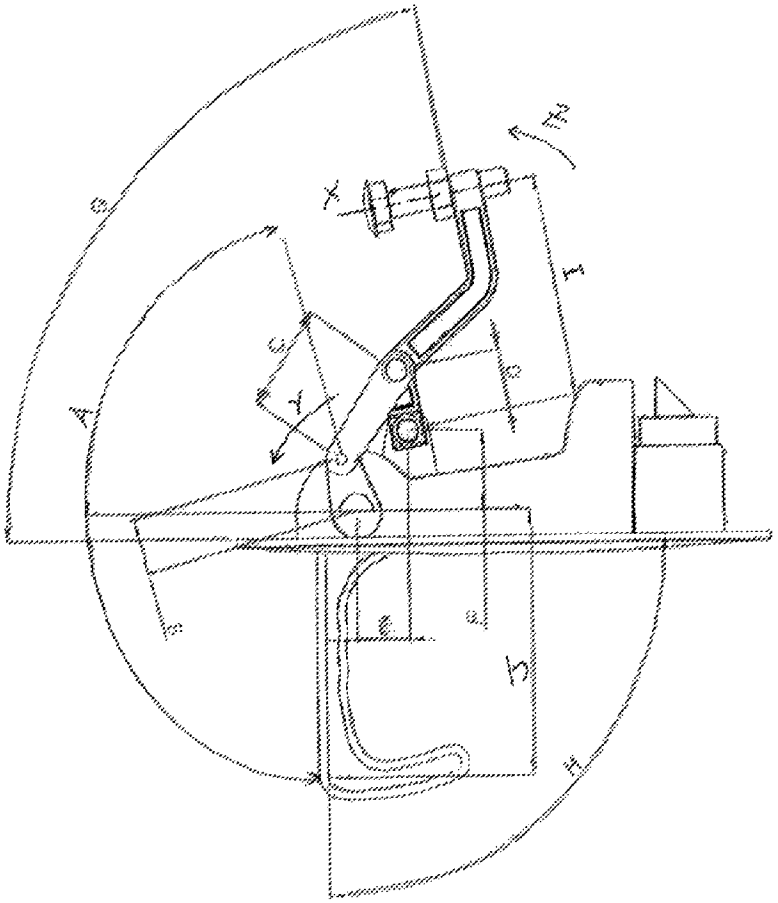
FIG. 4 is a side view of a compression latch according to the embodiment of FIGS. 1 to 3 in a fully open position.
Figure 5:
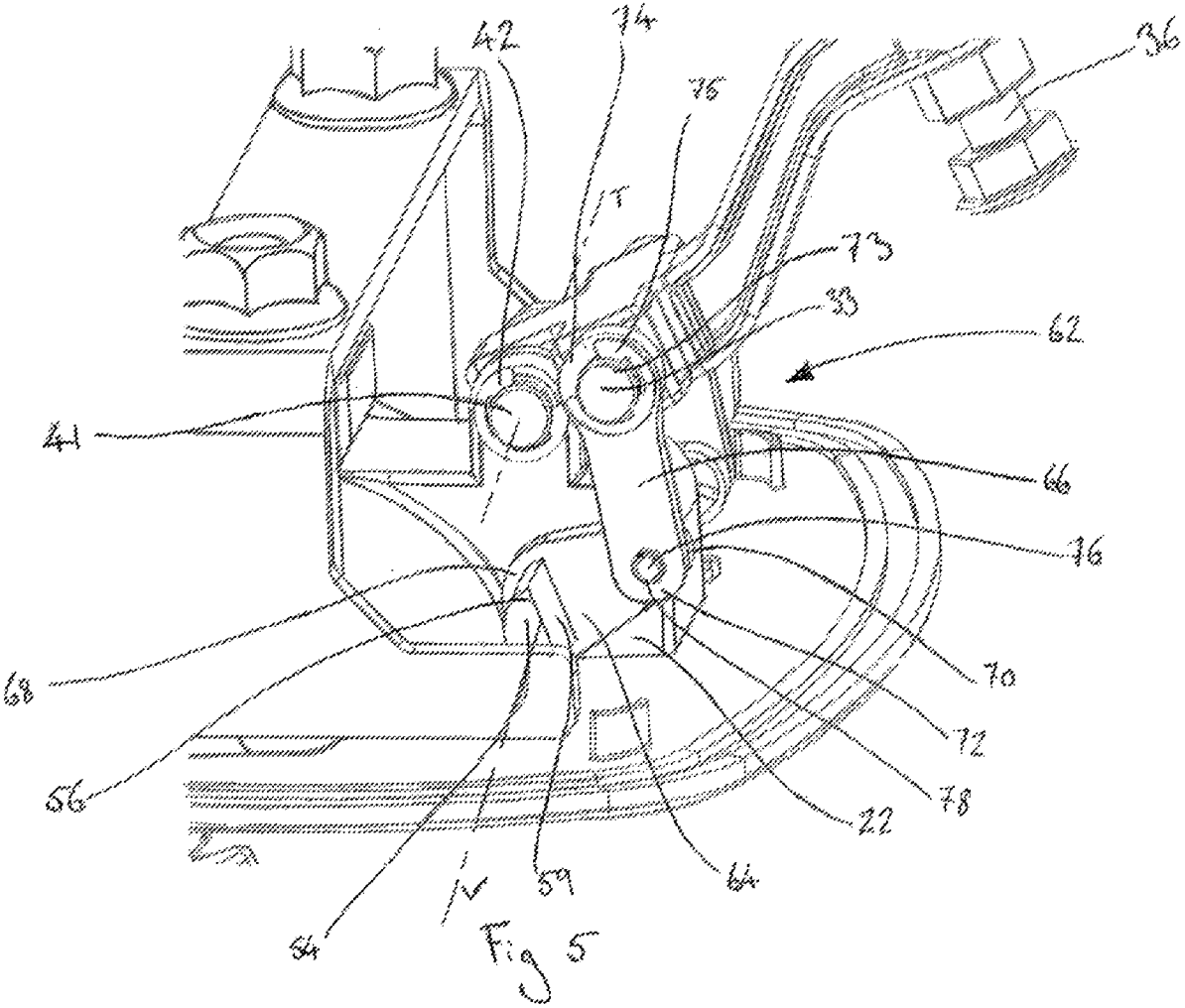

The handle shaft 54 is cylindrical for most of its length and has semi-circular ends 58 with a flat face 59 (see FIG. 5). The cylindrical portion extends through the side walls 22 of the handle recess 21 to the inboard side 20. O-ring seals (not shown) on the handle shaft 54 seal the inboard side 20 from the outboard side 19. A torsion coil spring 60 is positioned over one of the ends 58 such that one end of the spring 60 is adjacent the flat face 59 and the other end of the spring 60 is adjacent the inboard side 20 of the housing 12. Pivoting the handle 16 from an open position to the closed position causes the handle shaft 54 to act on the spring 60. If the handle 16 is released, the spring 60 acts on the shaft end 58 to return the handle 16 to the open position. Angle H on FIG. 4 is the variable angle between the handle 16 and the housing body 18.

In alternative embodiments, the spring 60 may be arranged to return the handle 16 to the closed position.

The housing 12 also has at its outboard side 19 a cylindrical lock recess 29, which houses a cylinder lock 24. The lock 24 includes a latching mechanism **24*a* used to retain the latch 10 when in the closed position, and prevents unauthorised release of the latching mechanism 24*a*. The lock 24 includes a push-button latch release mechanism (not shown) and a pivotable cover flap 37**.

The latch member 14 has a latch arm 30 having a striker end 32 and a connection end 34, and a striker 36 in the form of a bolt held in a threaded aperture **32*a* at the striker end 32 of the latch arm 30. The striker 36 has a longitudinal axis X, and is held in place by a striker locking nut 38. The position of striker 36 within the latch arm 30 can be adjusted by screwing the striker 36 to the required position, and adjusting the locking nut 38. The connection end 34 defines a cylindrical aperture (not shown). The striker end 32 and the connection end 34 are substantially parallel to one another in this embodiment, and are separated by a central portion 35 that is at an angle of approximately 45° to the ends 32, 34, so that the latch arm 30** is cranked inboard.

The latch member 14 is pivotably connected to the housing 12 by a main shaft 40 that passes through the latch arm cylindrical aperture and the apertures of the latch member mounting point 26 to form a latch member pivot point 41. The latch member pivot point 41 has a longitudinal axis T (see FIG. 5) parallel to the plane of the housing body 18, and the axis V of the handle pivot point, and spaced therefrom. A shaft clip 42 on either end of the main shaft 40 retains the main shaft 40 within the mounting point 26. The main shaft 40 rotates with the latch member 14 and can be rotated in either direction within the mounting point 26. Angle G on FIG. 4 is the variable angle between the latch member 14 and the housing body 18.

The latch arm 30 has a crossbar 31 positioned towards its connection end 34. The crossbar 31 defines a bore, within which is held a link shaft 33.

The latch member 14, handle 16 and striker 36 are in this embodiment made of zinc alloy, though other suitable materials may be used.

The latch 10 further comprises a linkage indicated generally at 62 (e.g. as shown in FIG. 5) that connects the latch member 14 and the handle 16. The linkage 62 has two pairs of first 64 and second 66 links, one pair on either side of the latch member and handle pivot points 41, 56.

Each first link 64 has a rounded first end 68 and a rounded second end 70. Each first end 68 defines a semi-circular aperture (not shown) that corresponds to the ends 58 of the handle shaft 54. The second end 70 defines a circular aperture (not shown). The first links 64 are positioned one on each end 58 of the handle shaft 54, with the first end 68 of each link 64 fitted over the handle shaft 54, so that the first links pivot together with the handle 16. The first link 64 on the same side of the handle shaft 54 as the spring 60 is positioned between the handle pivot point 56 and the spring 60.

Each second link 66 has a rounded first end 72 and a rounded second end 74. The first end 72 of each second link 66 is pivotably mounted to the second end 70 of the first link 64. The second end 74 defines a circular aperture configured to be pivotably mounted to the link shaft 33. The second links 66 are positioned one on each end of the link shaft 33 to form two second link pivot points 73. The second end 74 of each link 66 is pivotably fitted over the link shaft 33 and held in place by a shaft clip 75. The first end 72 of each second link 66 and the second end 70 of each respective first link 64 are pivotably connected by a shaft 76, forming two linkage pivot points 78 between the latch arm 30 and the housing body 18, i.e. outboard of the latch arm 30. The linkage 62 is therefore of the "four-bar" type, with the housing forming the fixed one of the bars.

In order for the latch 10 to be moved to the closed position, the handle 16 is pivoted about the handle pivot point 56. The first links 64 are pivoted about the handle pivot point 56 with the handle 16 in the direction Y (see FIG. 4). This moves the second links 66 towards the housing body 18 and, in turn, causes the latch member 14 to pivot about the latch pivot point 41 in the direction Z (see FIG. 4) towards the body 18. The striker end 32 of the latch arm 30 and, with it, the striker 36, is pivoted towards the closure. Pressure is thus applied to the closure surround 8.

In this embodiment, distances and angles marked on FIG. 4 are as follows:

| | | |
|---|---|---|
| Angle between each first link 64 and the handle 16 | A | 165° |
| Distance between centre points of apertures of first link 64 | B | 12.5 mm |
| Distance between centre points of apertures of second link 66 | C | 24 mm |
| Distance between longitudinal axis of the shaft 33 and the axis T | D | 14 mm |
| Distance between axes T and V, parallel to the housing body 18 | E | 12 mm |
| Distance between axes T and V, perpendicular to the housing body 18 | F | 18.5 mm |
| Angle between the latch member 14 and the housing body 18 | G | variable |
| Angle between the handle 16 and the housing body 18 | H | variable |
| Distance between axes X and T | I | 51 mm |
| Length of handle 16 from the free end 46 to axis V | J | 60 mm |

With the above geometry, the effect of the linkage 62 is that angular movement of the handle 16 results in lesser angular movement of the latch member 14. As the handle 16 travels further than the latch member 14, the amount of force applied to the handle 16 at a given location is less than the resultant force at an equivalent location on the latch member 14. This improves ease of operation of the latch 10. Another means of decreasing the force that need be applied would be to increase the length of the handle 16. The present invention advantageously provides a compact alternative to such a method.

Additional force may be required to fully close the latch 10, particularly if the latch 10 is used with a heavy closure or one which requires improved sealing. The most force will be required at the point where the latch member 14 contacts the closure surround 8. This may be referred to as the "active zone" and is taken to start when the latch member 14 is at approximately 11.3° to the housing body 18, i.e. where G=11.3°. At this point, the handle 16 is at approximately 15° to the body 18, i.e. H=15°. At G=0°, H=0°. To close, the latch member 14 must be pivoted through approximately 11.3°. The handle 16 is moved through approximately 15° in order to effect the movement of the latch member 14. The angular compression ratio at the active zone is therefore G/H, i.e. 1.33. That is, the amount of force applied at the striker 36 to the closure is 1.33 times the force applied by the user to the free end 46 of the handle 16.

For the pressure to be removed from the closure to allow the closure to be opened, the latch 10 must be released. The handle 16 can in this embodiment be pivoted to an angle H of 90° to the body 18, at which point the latch member 14 will be at an angle G of more than 80° to the body 18. This leaves suitable clearance between the latch member 14 and the closure surround 8. Clearance between the latch member 14 and the closure surround 8 is increased by the latch pivot point 41 being removed from the first edge 7 of the housing 12 in a direction parallel to the plane of the housing—i.e. further from this edge than the handle pivot point 56.

As previously stated, the measurements provided relate to an exemplary embodiment of the present invention. Other distances between pivot points can be used. However, the ratio of the distances used in this embodiment have been found to be optimal for the latch 10. Variation of the measurements can improve some features but hinder others. For example, increasing distances D or E would lead to an increase in the mechanical advantage but a decrease in the maximum angle G, i.e. a reduction in the clearance between the latch member 14 and the closure surround 8. Decreasing the distance B would do the same. Increasing distance F more than is needed for clearance is not believed to lead to a particular advantage and increases the minimum space required for the latch 10. Increasing the angle A to more than 165° can reduce the mechanical advantage and the fully open angle G. If the angle A is less than 165°, the first links 64 may impinge on the housing 12 as the handle 16 nears the closed position.

Figure 6:
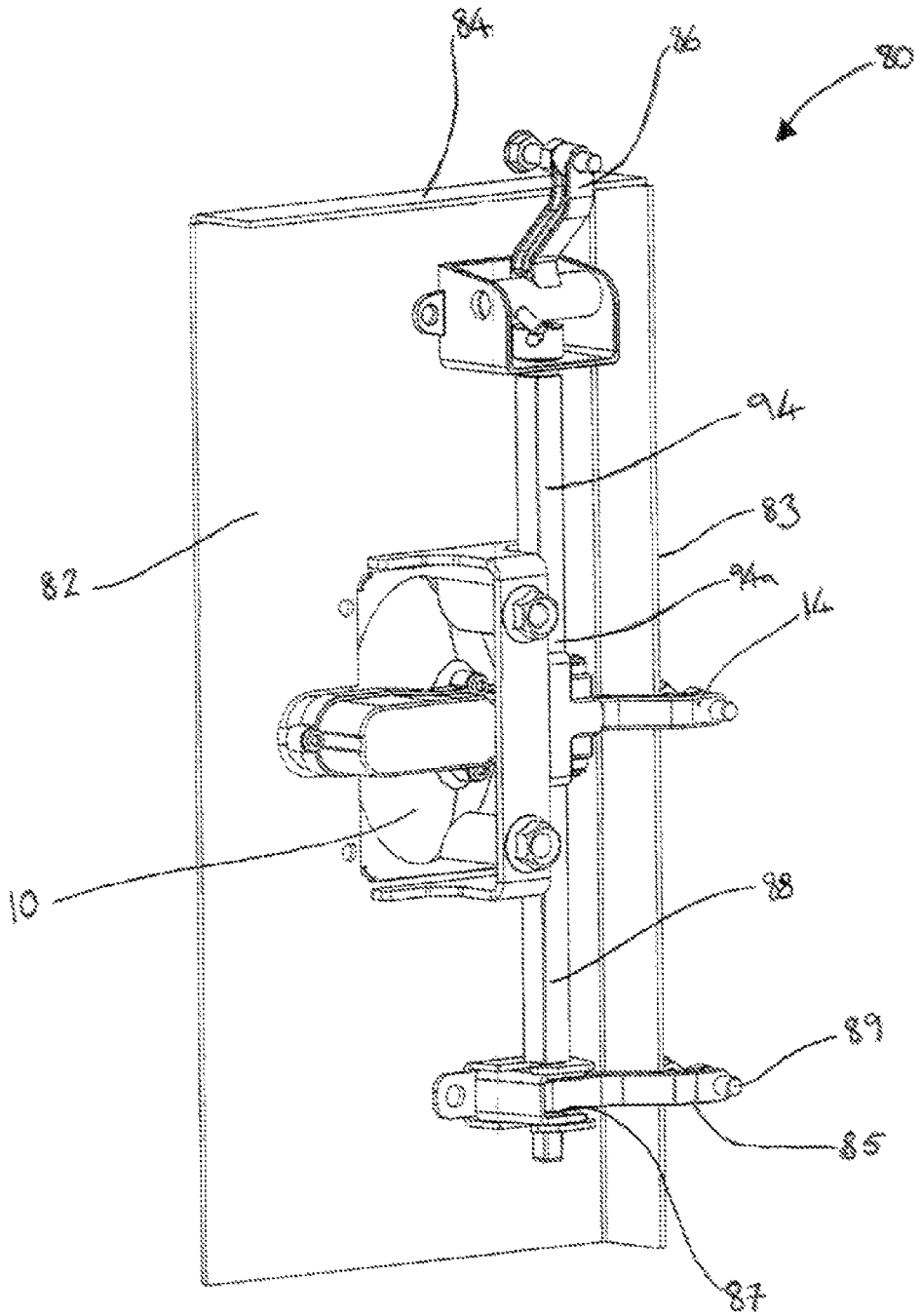
FIG. 6 is a perspective view of a latch assembly incorporating the compression latch according to the embodiment of FIGS. 1 to 5.

The latch 10 is shown in FIG. 6 as part of a latch assembly 80. The latch assembly 80 is attached to a closure 82 (e.g. a door) having a first edge 83 and a second edge 84, each edge being configured to abut a closure surround (not shown). The latch 10 is positioned on the first edge 83. The latch assembly 80 includes a second latch member 85 with a striker 89, positioned on the first edge 83, parallel to the latch member 14. A third latch member 86 with a striker 90 is positioned on the second edge 84, perpendicular to the first and second latch members 14, 85. The second and/or third latch members may be used to provide additional retention of large closures. In other embodiments only one, or more than two additional latch members may be provided.

The second latch member 85 is pivotably mounted to the closure 82 at a mounting point 87 by means of a second latch member shaft (not shown) that turns with the second latch member 85. The main shaft 40, about which the first latch member 14 pivots on operation of the handle 16, is fitted with a non-circular drive extension (not shown) at each end, each drive extension being configured to turn about the axis of the main shaft 40 (e.g. due to interference fit by virtue of a grub screw or a roll pin). An extension shaft 88 connects the second latch member shaft (not shown) to the main shaft 40 via one of the drive extensions. The second latch member 85 is thus pivoted in synchronisation with the first latch member 14 on operation of the latch 10 such that the striker 89 applies pressure to the closure simultaneously to the striker 36. As the main shaft 40 has more clearance from the closure 82 at the latch pivot point 41, the extension shaft 88 is also removed from the closure 82. This prevents damage being caused to the extension shaft 88 and the closure 82 during pivoting of the latch members 14, 85.

Figure 7:
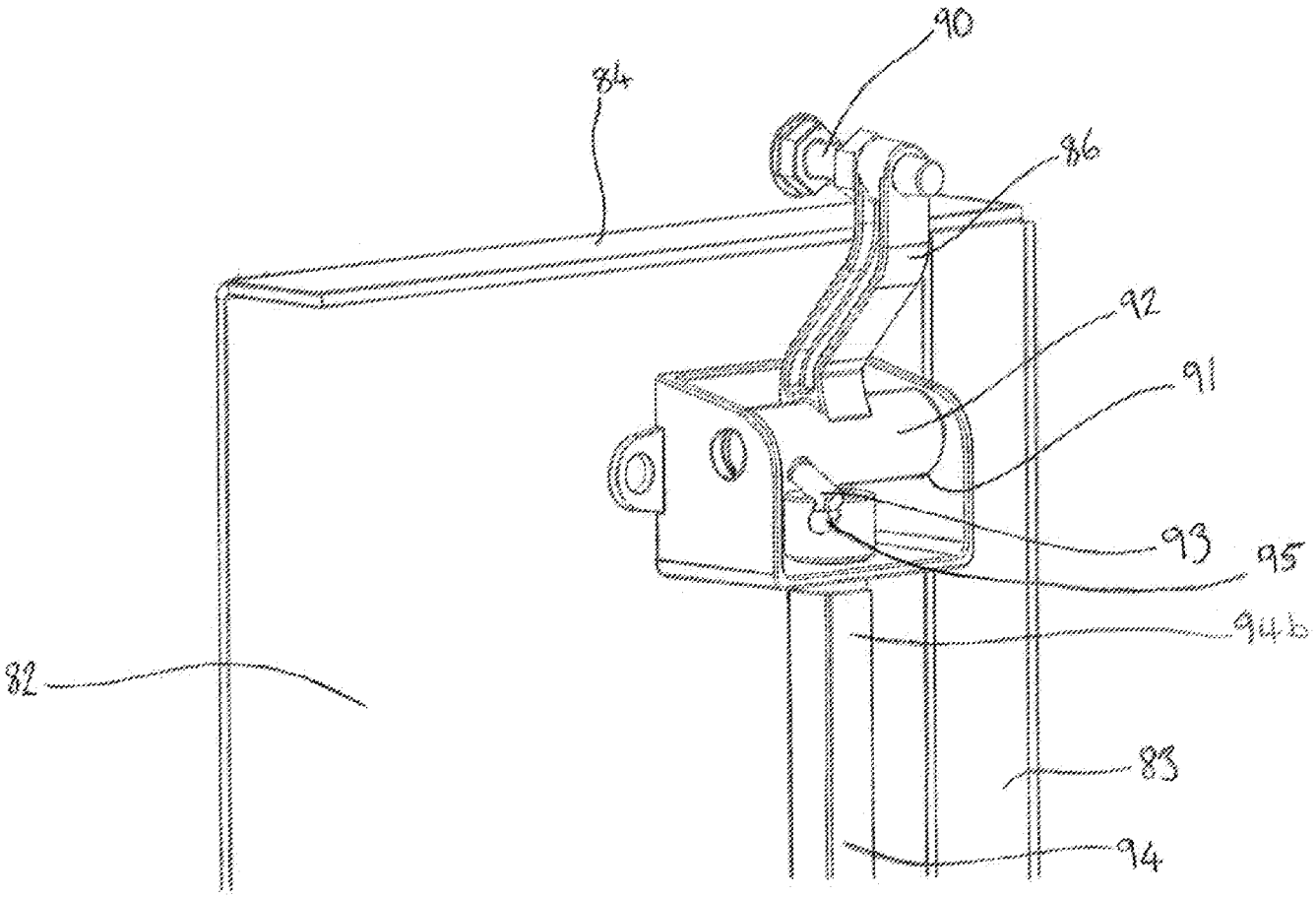
FIG. 7 is a partial perspective view showing part of the latch assembly according to the embodiment of FIG. 6 in more detail.

FIG. 7 shows an example of the third latch member 86 in more detail. The third latch member 86 is pivotably mounted to the closure 82 at a mounting point 91. The mounting point 91 includes a pivotable shaft 92, to which the third latch member 86 is connected. The shaft 92 has a cylindrical projection 93 extending radially, generally away from the closure 82. The shaft 92 is resiliently biased towards an open position. An extension shaft 94 is connected at a first end **94*a* to the main shaft 40** via one of the drive extensions. A second end

94*b* of the extension shaft 94 extends to the mounting point 91. The second end 94*b* includes a radial projection 95 extending generally inboard from the closure 82. The projection 95 abuts the projection 93 of the third latch member shaft 92. As the extension shaft 94 is rotated with the main shaft 40 the projection 95 is also rotated, and in turn displaces the projection 93. This causes the third latch member shaft 92, and thus the third latch member 86, to rotate with the first and second latch members 14, 85. The striker 90 is thus configured to apply pressure to the closure simultaneously to the remaining strikers 36, 89. The extension shaft 94 and its projection 95 act as a drive that enables the third latch member 86 to be positioned at 90° to the first latch member 14.

Figure 8:
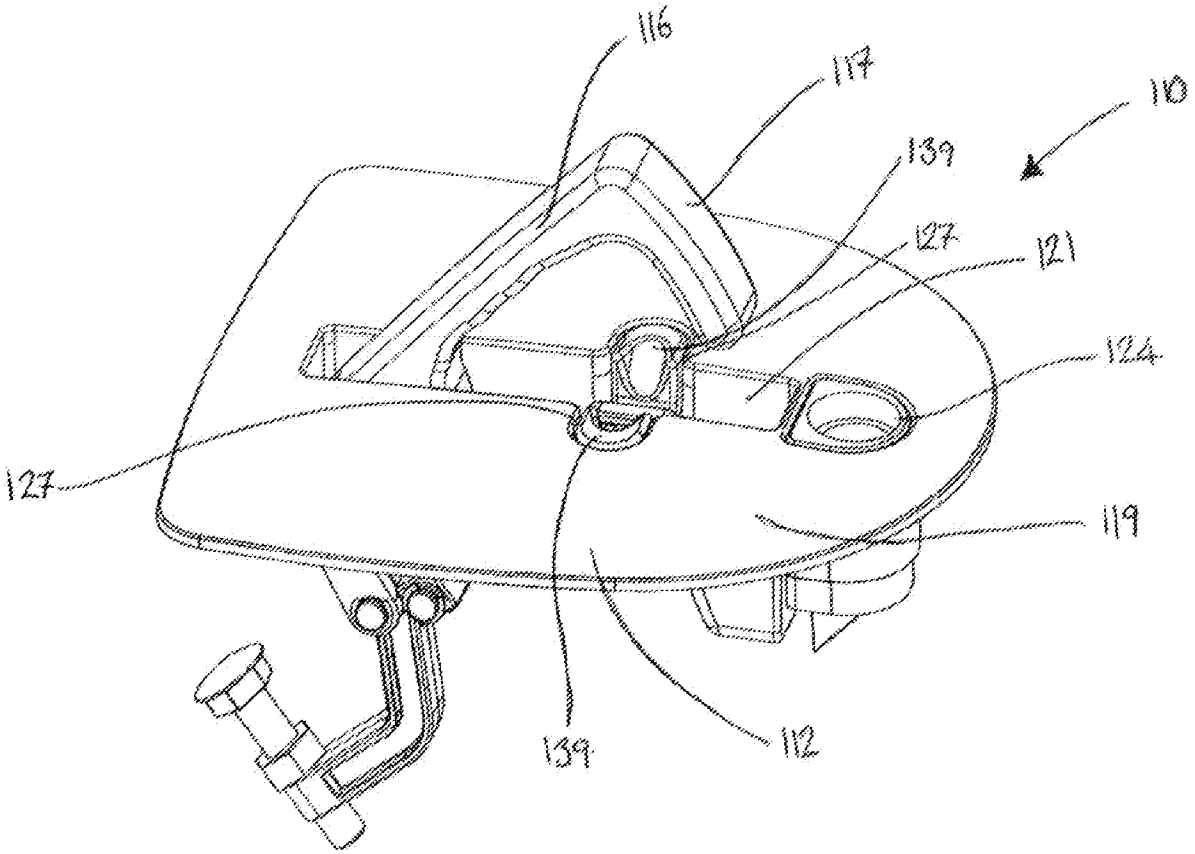
FIG. 8 is a perspective view of a compression latch according to a second embodiment of the present invention.
Figure 9:
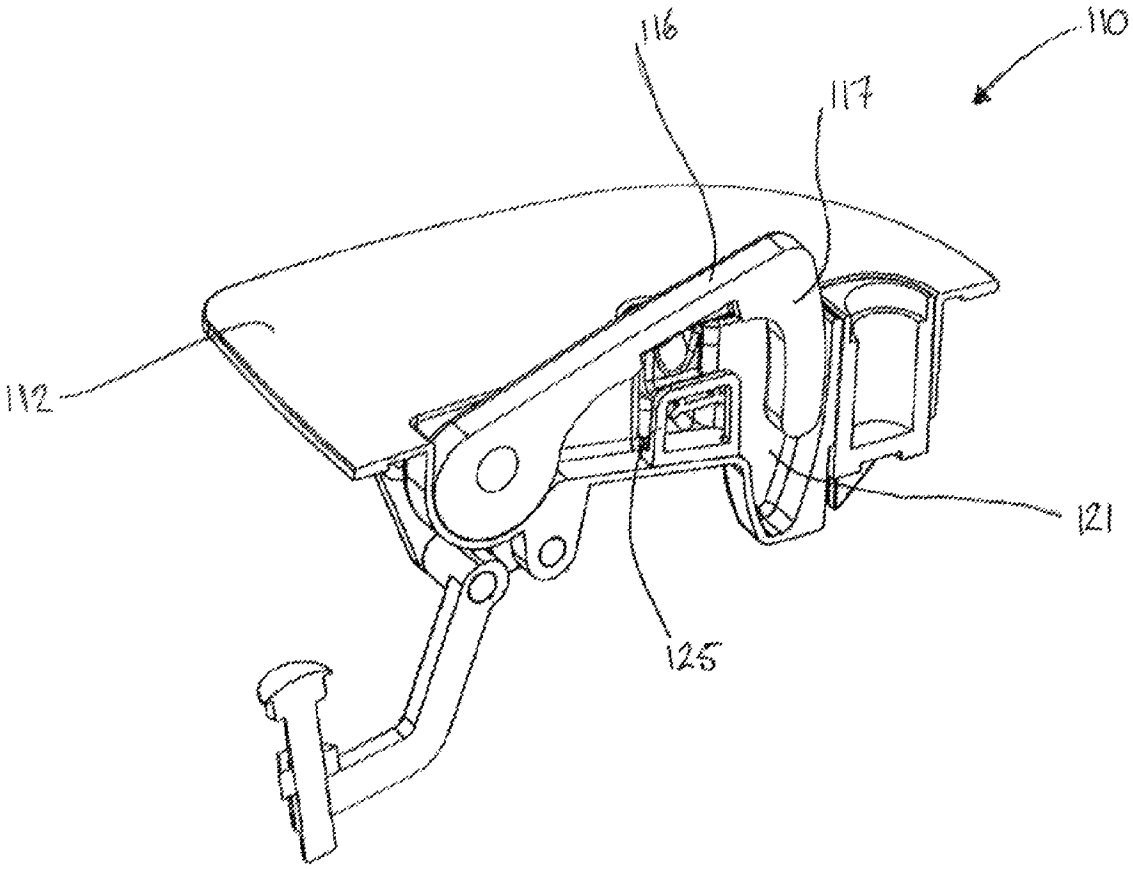
FIG. 9 is a cross-sectional view through the compression latch of the embodiment of FIG. 8.

A second embodiment of the invention is shown in FIGS. 8 and 9. Features corresponding to those of the first embodiment have been given corresponding reference numbers with the additional prefix "1". Only features that differ from those of the first embodiment are discussed in more depth.

The latch 110 of second embodiment of the invention is similar to that of the previous embodiment, except in that the handle 116 is L-shaped rather than T-shaped. The crossbar 117 of the "L" 116 extends towards the housing 112. The handle recess 121 is in this embodiment substantially rectangular, with indentations 127 on either side to allow the handle 116 to be grasped when in the closed position. The padlock loop 125 extends outboard, and is flanked in this embodiment by spring-loaded covers 139 set in the indentations 127. The covers 139 can be pushed inboard to allow a padlock (not shown) to be attached to the padlock loop 125. The handle recess 121 is deeper at one end to allow the handle 116 to be fully received the housing 12.

The latch member shaft 140 comprises in this embodiment square portions towards each of its ends. Extension shafts for satellite latch members, such as extension shafts 88, 94 of the previous embodiment, can thus be connected to the latch member shaft 140 without the need for further components.

Figure 10:
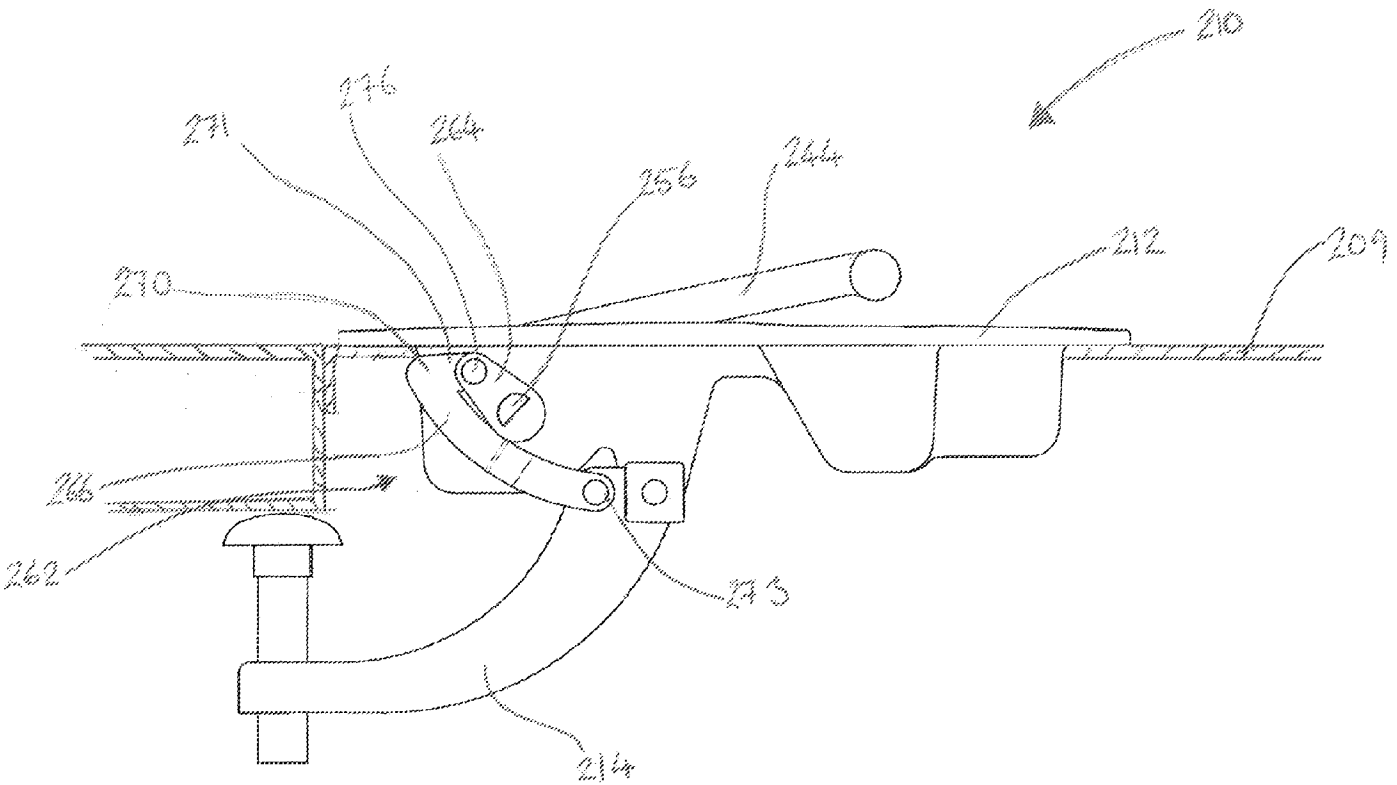
FIG. 10 is a side view of a compression latch according to a third embodiment of the present invention in a near-closed position.
Figure 11:
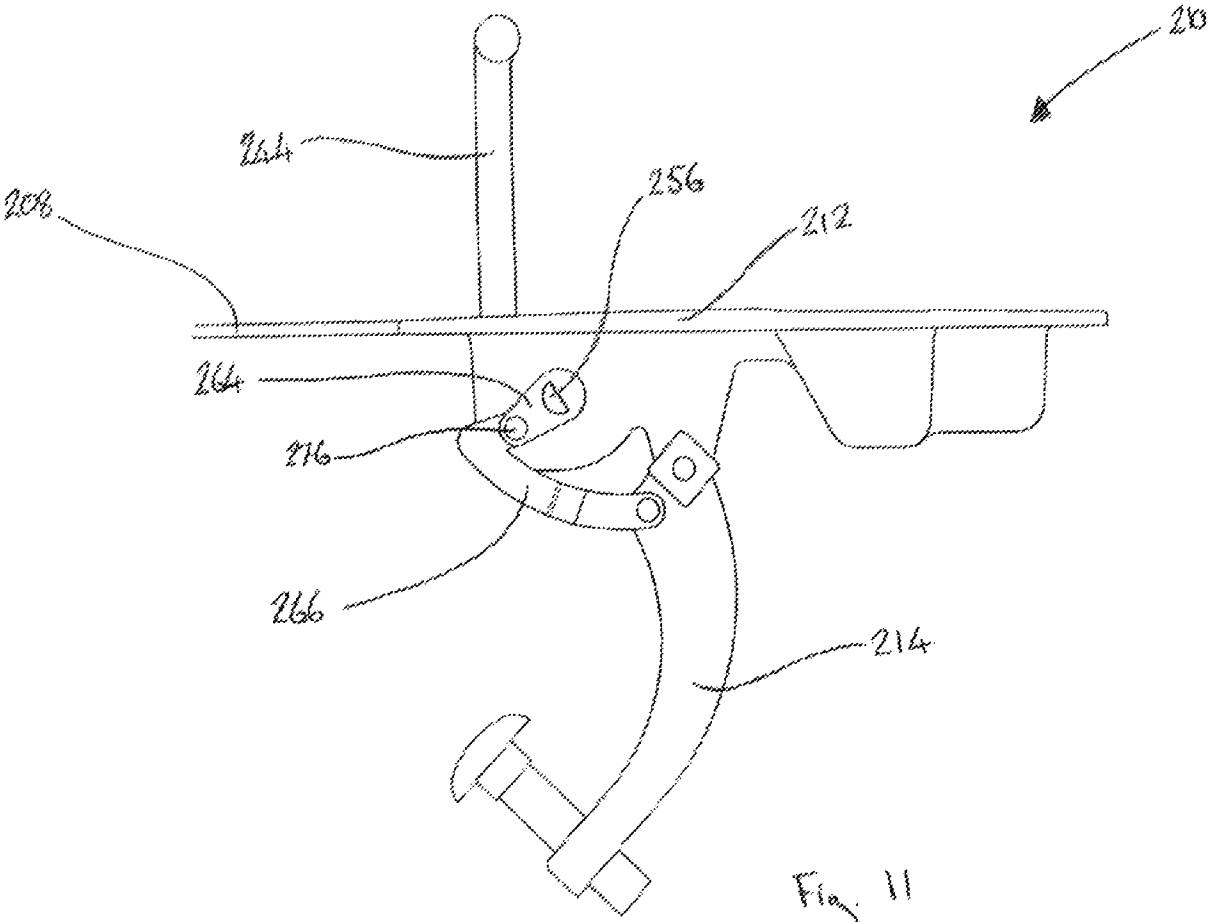
FIG. 11 is a side view of a compression latch according to the embodiment of FIG. 10 in an open position.

A third embodiment of the invention is shown in FIGS. 10 and 11. Features corresponding to those of the previous embodiments have been given corresponding reference numbers with the additional prefix "2". Only features that differ from those of the first embodiment are discussed in more depth.

FIG. 10 shows a latch 210 in a near-closed position. The latch arm 230 of this embodiment is curved in shape. The linkage 262 of the latch 210 remains a four-bar linkage, but the geometry is different to that of the previous embodiments. In this embodiment, the first links 264 are at an angle of approximately 110° to the handle arm 244, with the second ends 270 extending towards the housing body 218 when the latch 210 is in the closed position. The second links 266 are longer than those of the previous two embodiments and are curved away from the handle pivot point 256, with a projection 271 at each first end 270. Each projection 271 defines a circular aperture (not shown) by which each second link 266 is pivotably connected to the shaft 276. The second end 272 of each second link 266 is pivotably connected to the latch arm 230 at the second link pivot point 273.

FIG. 11 shows the latch 210 in a fully open position. The length of the second links 266 allows the latch pivot point 241 to be further removed from the edge of the closure 209 than in the previous embodiments, allowing the closure 209 to be opened easily without interference from the latch member 214. The curved nature of the second links 266 prevents the second links 266 from interfering with the handle pivot point 256.

Figure 12:
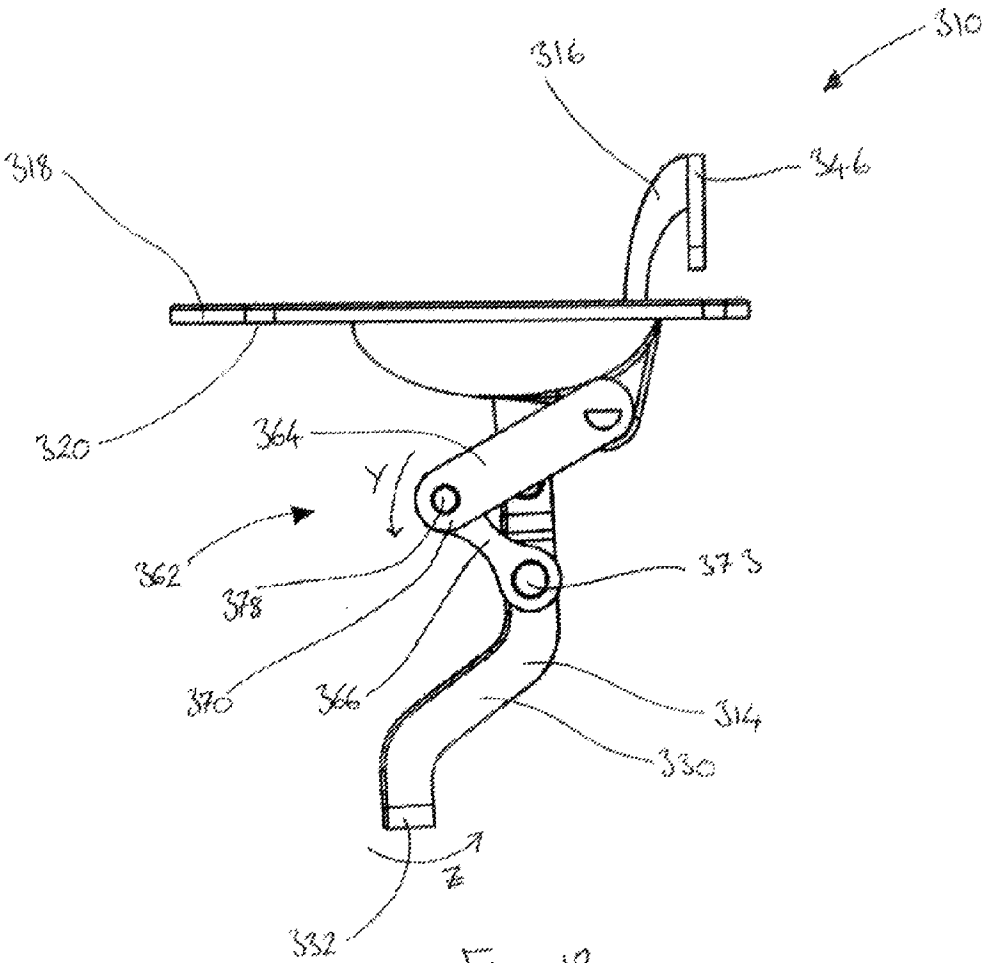
FIG. 12 is a side view of a compression latch according to a fourth embodiment of the present invention in a fully open position.
Figure 13:
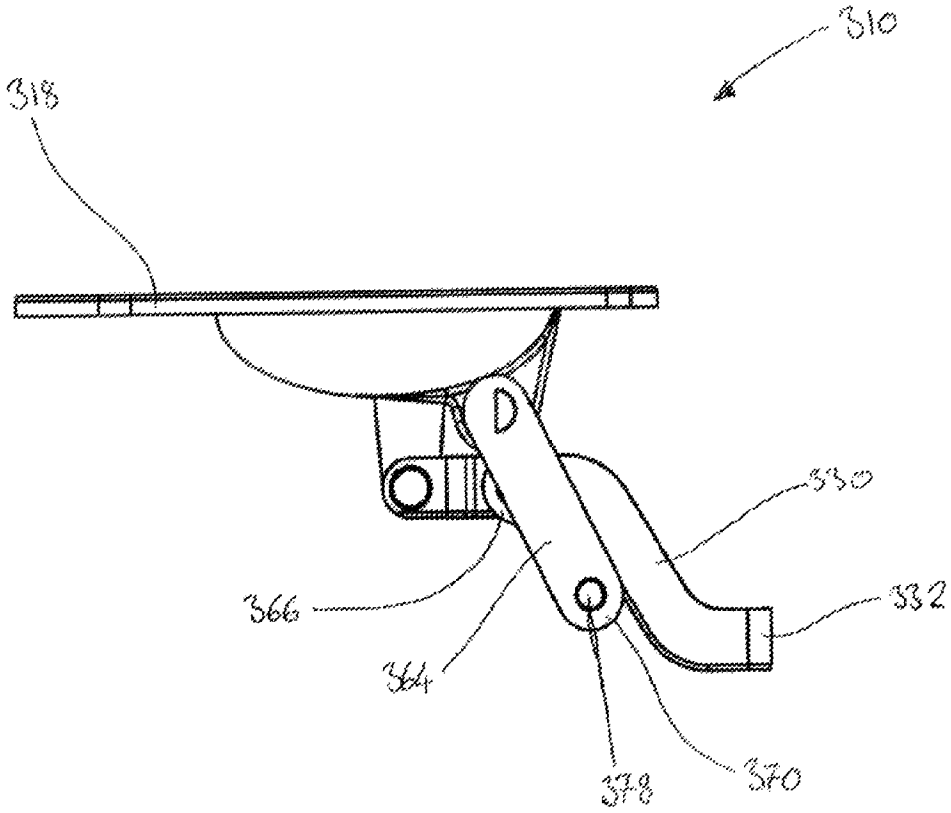
FIG. 13 is a side view of a compression latch according to the embodiment of FIG. 12 in a closed position.

A fourth embodiment of the invention is shown in FIGS. 12 and 13. Features corresponding to those of the previous embodiments have been given corresponding reference numbers with the additional prefix "3". Only features that differ from those of the first embodiment are discussed in more depth.

A latch 310 is shown in an open position in FIG. 12 and closed in FIG. 13. In this embodiment, the latch member 314 does not comprise a striker. The free end 332 of the latch arm 330 acts as a striker, applying pressure to a closure surround (not shown) at 90° to the housing body 318 when in a closed position.

The linkage 362 of this embodiment differs to those of the previous embodiments. The first links 364 are at an angle of approximately 150° to the handle arm 344. As shown in FIG. 12, each of the first links 364 crosses the latch arm 330, with each second end 370 extending over the latch arm 330. The linkage pivot point 378 is thus inboard of the latch arm 330.

In use, rotation of the handle 316 from the open position shown in FIG. 12 towards the closed position of FIG. 13 causes rotation of the first links 364 away from the housing body 318 in a direction Y, passing over the second link pivot points 373 as they rotate. The first links 364 move the second links 366 towards the housing body 318, which in turn causes the latch member 330 to rotate towards the closed position in a direction Z.

As with the previous embodiments, the linkage 362 causes angular movement of the handle 316 to result in smaller angular movement of the latch member 314. As the handle 316 travels further than the latch member 314, the amount of force applied to the handle 316 is less than the resultant force at the latch member 314. The arrangement of the linkage 362 of this embodiment provides this mechanical advantage with a more compact linkage 362 than that of the previous embodiments. A compact linkage 362 is advantageous as there is often limited space inboard a latch. Over-centre motion of the linkage 362 is required for the latch 310 to move between the fully open and closed positions, which hinders forcing of the latch 310, and may remove the need for a separate biasing or retaining mechanism in some circumstances. Applying force to the handle 316 when the latch 310 is in the closed position causes the second links 366 to act against rotation of the first links 364, so helping to prevent opening of the latch 310.

The angular compression ratio at the active zone of this embodiment is on average 2.4. When the handle moves between 38° and 28°, the latch moves between about 4.6° to 0.5°, giving the average angular compression ratio of 2.4. That is, the amount of force applied at the free end 332 to the closure is 2.4 times the force applied by the user to the free end 346 of the handle 316.

Figure 14:
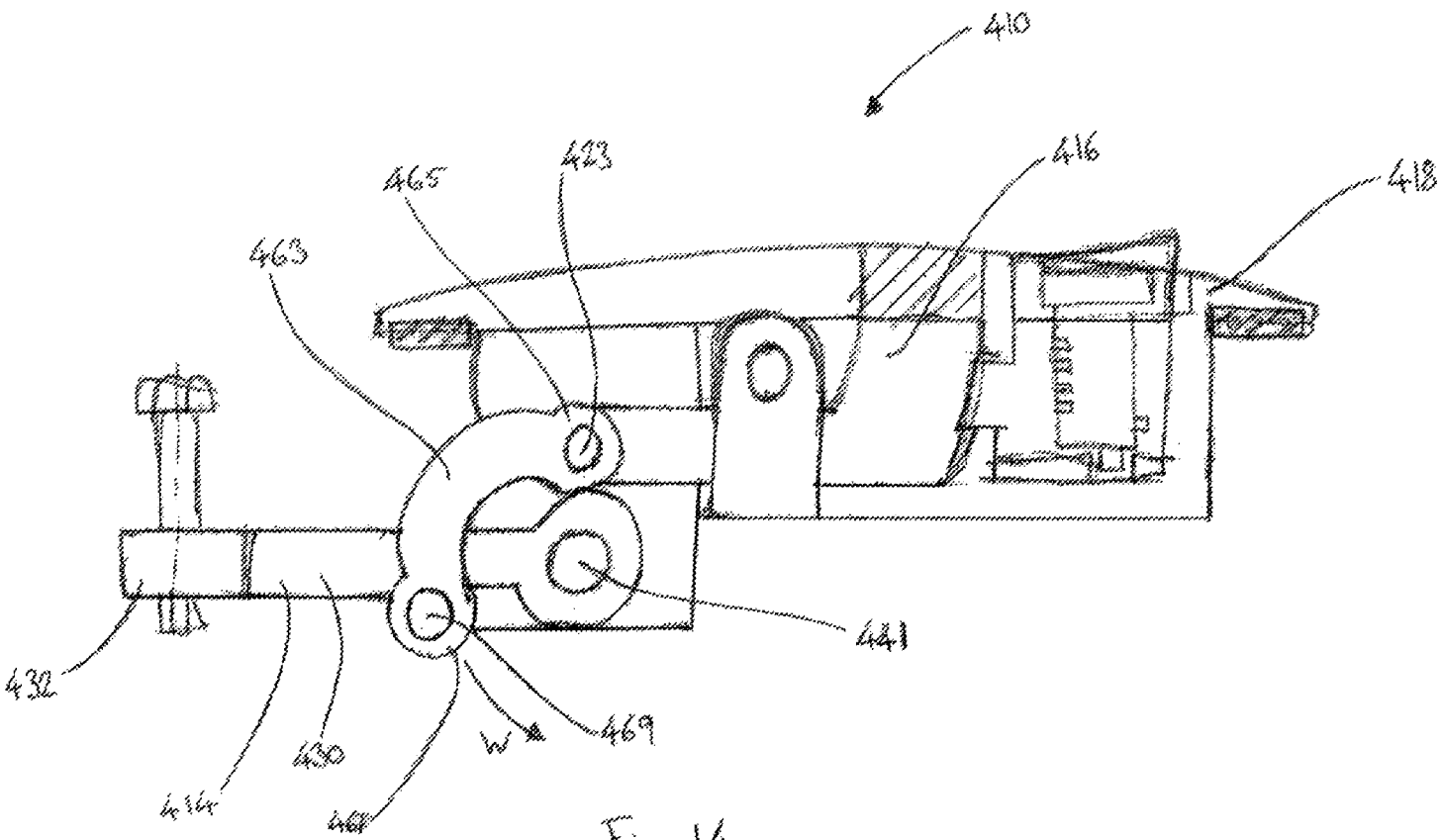
FIG. 14 is a side, partially cross-sectional, view of a compression latch according to a fifth embodiment of the present invention.

A fifth embodiment of the invention is shown in FIG. 14. Features corresponding to those of the previous embodiments have been given corresponding reference numbers with the additional prefix "4". Only features that differ from those of the first embodiment are discussed in more depth.

The latch member 414 is in this embodiment resiliently biased towards an open position by a biasing device (not shown). The latch 410 has two link members 463 having first and second ends 465, 467 and curved through 90°. The link members 463 are attached by an aperture (not shown) defined by the first end 465 to either side of the handle mounting point 423. The link members 463 are pivoted about the handle mounting point 423 together with the handle 416. The second ends 467 each define an aperture (not shown) and are connected to one another by a shaft 469. The latch arm 430 passes between the two link members 463, and is biased against the shaft 469.

FIG. 14 shows the latch 410 in a closed position, with the latch member 414 held in place by the shaft 469. As the handle 416 is opened, the two link members 463 pivot about the handle mounting point 423 such that their second ends 467 and with them the shaft 469 move away from the housing body 418 in the direction W. As the link members 463 pivot, the shaft 469 slides down the latch arm 430 towards the latch pivot point 441, and the latch member 414 is allowed to pivot about the latch pivot point 441 towards an open position. On closing, the handle 416 is returned towards the closed position by rotation towards the housing body 418, causing the two link members 463 to pivot about the handle mounting point 423 towards the housing body 418. The shaft 469 slides along the latch arm 430 towards the striker end 432, causing the latch member 414 to pivot about the latch pivot point 441 and return to the closed position.

The arrangement of this embodiment provides a simple method of latch operation, with the advantage of the latch pivot point 441 being spaced from the latch housing 412. This arrangement also results in a variation in mechanical advantage through the range of motion of the latch arm 430.

In an alternative to this embodiment (not shown), the latch arm 430 defines a slot through which a pin is held by the link members 463. The pin acts to move the latch arm 430 towards the open or closed positions, removing the need for the latch arm 430 to be biased towards the open position.

Figure 15:
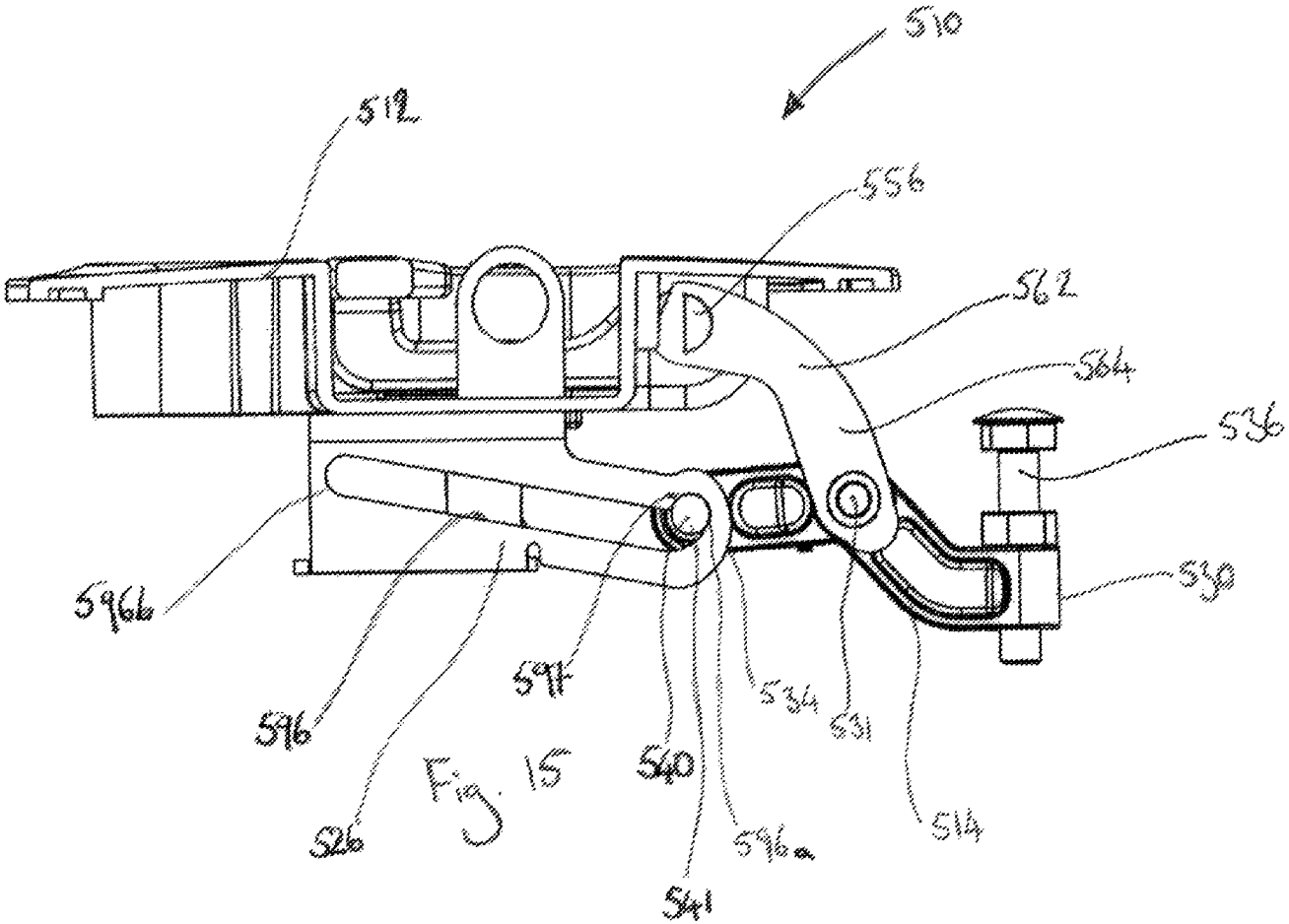
FIG. 15 is a view of a compression latch according to a sixth embodiment of the present invention in a closed position.
Figure 16:
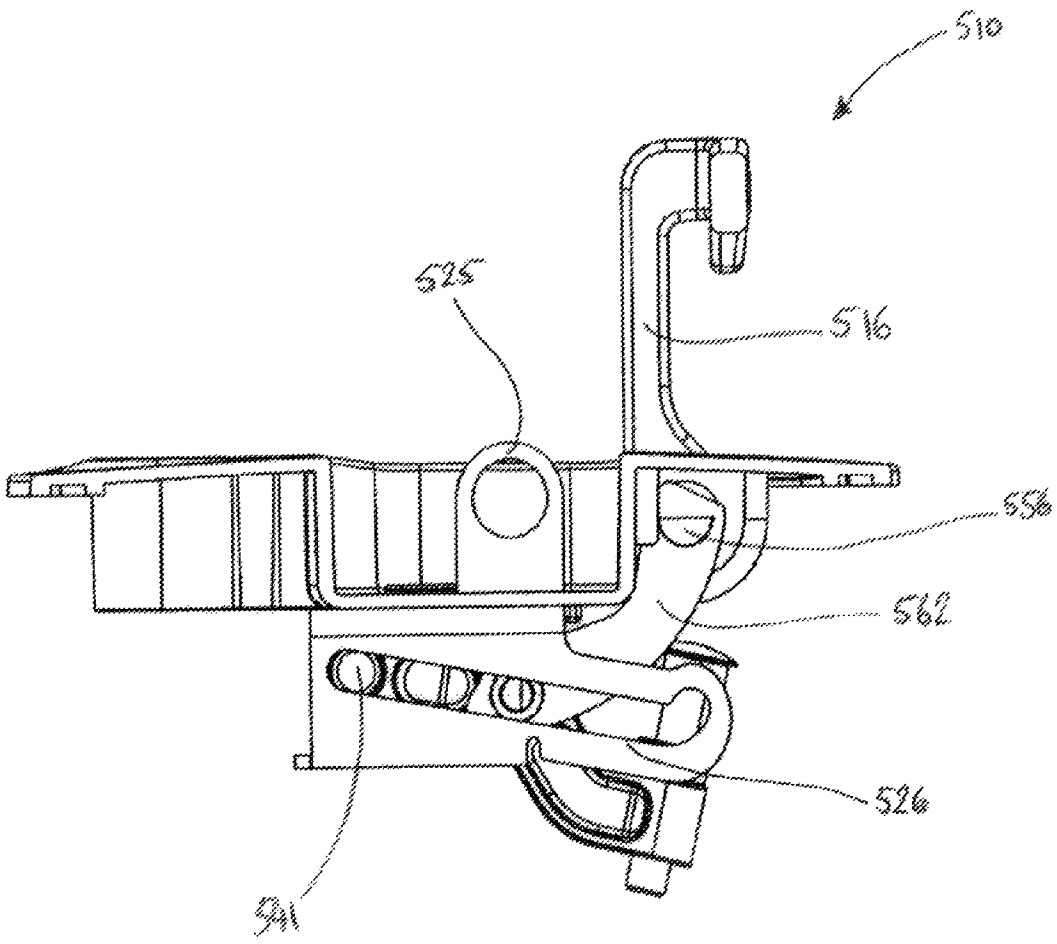
FIG. 16 is a view of a compression latch according to the embodiment of FIG. 15 in a fully open position.

A sixth embodiment of the invention is shown in FIGS. 15 and 16. Features corresponding to those of the previous embodiments have been given corresponding reference numbers with the additional prefix "5". Only features that differ from those of the first embodiment are discussed in depth.

The latch 510 of the sixth embodiment of the invention has a linkage 562 comprising a pair of links 564. The links 564 extend from the handle pivot point 556 to the latch member 514, where they are pivotably connected to a point 531 on the latch arm 530.

The connection end 534 of the latch member 514 is translatable as well as pivotable in the housing 512, as the latch member pivot point 541 is translatable with respect to the housing 512.

The latch member mounting point 526 of this embodiment comprises an opposing pair of slots 596. The slots 596 provide guide tracks for the latch member pivot point 541. Each end of the shaft 540 is supported within a respective slot 596, and is slidable along that slot 596. Each slot 596 has a first end 596*a* and a second end 596*b*. The first end 596*a* of each slot 596 has a dogleg 597 at an outboard side configured to receive the shaft 540 when the latch 510 is in the closed position, e.g. as shown in FIG. 15. The slots 596 are angled with respect to the plane, with the first end being inboard of the second end.

In this embodiment, the latch member mounting point 526 is in the same piece of material as the padlock loop 525. Both of these features 526, 525 must be of relatively strong material, so it is advantageous to provide both as a single component. However, in alternative embodiments the mounting point 526 and padlock loop 525 may be separate pieces.

In use, as the handle 516 is moved from the closed position of FIG. 15 to the fully open position of FIG. 16, the linkage 562 is moved with the handle 516 about the handle pivot point 556, and the latch member 514 is pivoted about the point 531 and the latch member pivot point 541. The connection end 534 moves from the dogleg 597 along the slots 596 to the second end 596*b* of the slots as the latch 510 moves from the closed to the open position. On closing of the latch 510, the shaft 540 drops into the dogleg 597, so that over-centre motion of the linkage 562 is required for the latch 510 to move between the fully open and closed positions, which hinders forcing of the latch 510, and may remove the need for a separate biasing or retaining mechanism in some circumstances.

As with the previous embodiments of the invention the handle 516 moves a greater angular distance than the shaft member 514, so a force advantage is gained, and less force need be applied at the handle 516 than is required at the striker 536. The compressive force applied is greater at the active zone, i.e. when the latch is close to closure.

An additional advantage of this embodiment is that it is relatively compact. Restraint of the connection end 534 of the sixth embodiment by the guide tracks 596 means that pivoting of the latch member 514 is controlled, so the striker 536 does not travel as far inboard as in previous embodiments. Advantageously, less space is thus required in the often limited space inboard a latch. The shape of the slots 596 may be altered to change the path of motion of the latch member 514.

Figure 17:
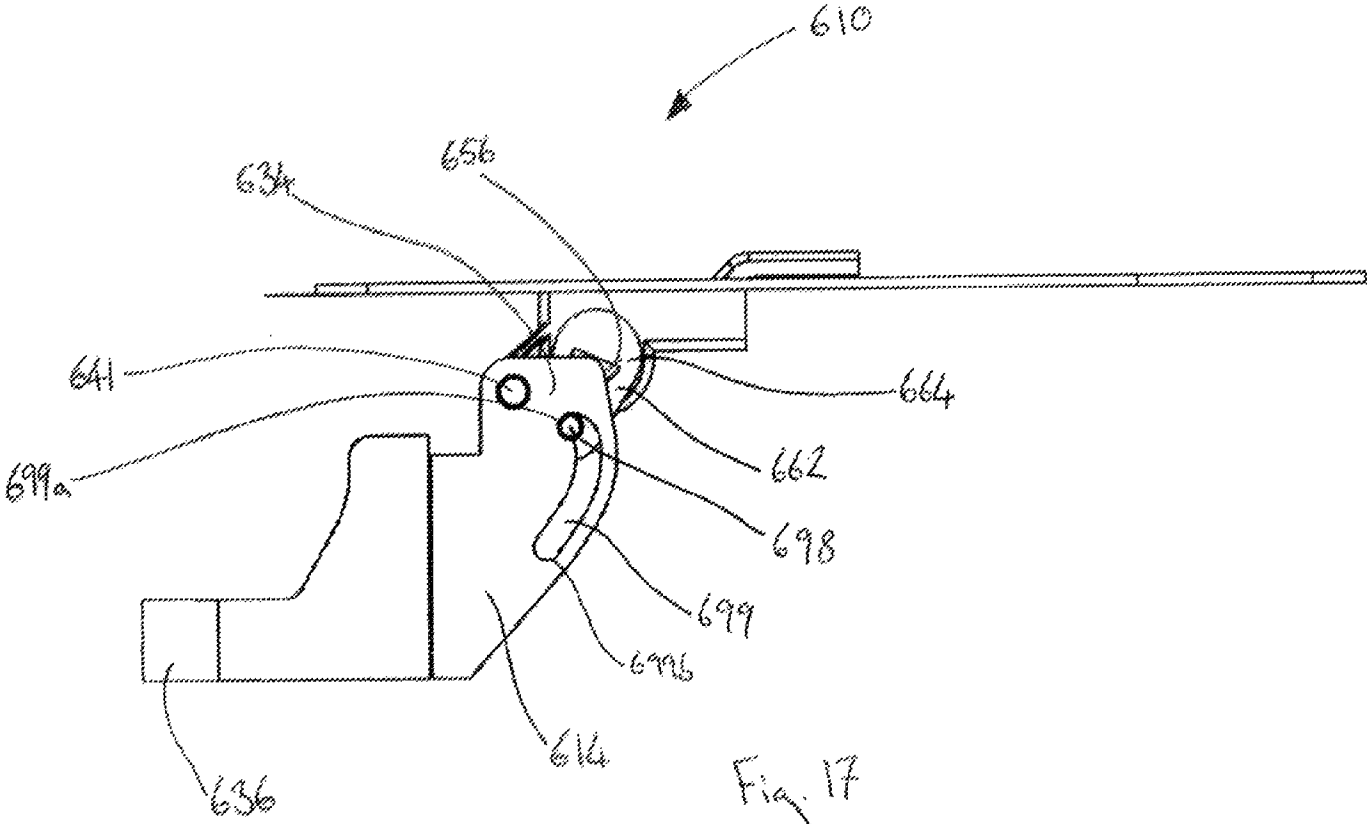
FIG. 17 is a view of a compression latch according to a seventh embodiment of the present invention in a closed position.
Figure 18:
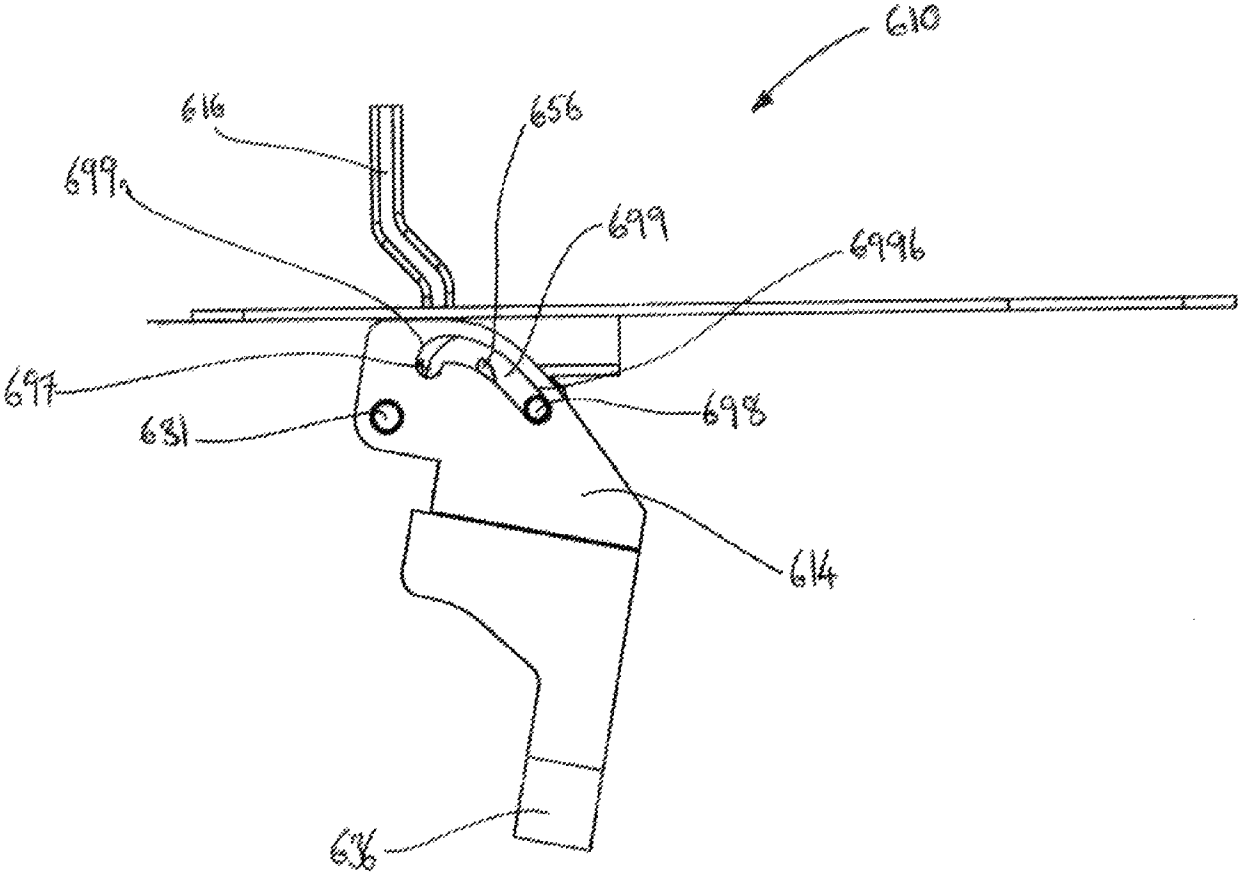
FIG. 18 is a view of a compression latch according to the embodiment of FIG. 17 in a fully open position

A seventh embodiment of the invention is shown in FIGS. 17 and 18. Features corresponding to those of the previous embodiments have been given corresponding reference numbers with the additional prefix "6". Only features that differ from those of the first embodiment are discussed in depth.

As with the sixth embodiment, the latch 610 of this seventh embodiment of the invention has a linkage 662 comprising a pair of links 664. In contrast to the previous embodiments, the latch member 614 extends either side of the linkage 662. The linkage 662 comprises a linkage shaft 698, and the latch member 614 defines an opposing pair of curved slots 699 configured to received either end of the linkage shaft 698, providing guide tracks 699 for the linkage shaft 698. The latch member 614 is pivotable and slidable relative to the linkage shaft 699.

The slots 699 each have a first end 699*a* and a second end 699*b*. The first end 699*a* of each slot 699 has a dogleg 697 configured to receive the linkage shaft 698 when the latch 610 is in the closed position, e.g. as shown in FIG. 17.

In use, as the handle 616 is moved from the closed position of FIG. 17 to the fully open position of FIG. 18, the linkage 662 is moved with the handle 616 about the handle pivot point 656. The linkage 662 in turn acts on the latch member 614 via the linkage shaft 698, causing the latch member 614 to pivot about the latch member pivot point 641. The linkage shaft 698 moves from the dogleg 697 at the first end 699*a* to the second end 699*b*, controlling pivoting of the latch member 614 as the latch 610 moves from the closed to the open position. On closing of the latch 610, the shaft 698 drops into the dogleg 697. Again, this means that over-centre motion of the linkage 662 is required for the latch 610 to move between the fully open and closed positions, which hinders forcing of the latch 610, and may remove the need for a separate biasing or retaining mechanism in some circumstances.

Once again, the handle 616 moves a greater angular distance than the shaft member 614, so a force advantage is gained, and less force need be applied at the handle 616 than is required at the striker 636. Again, the compressive force applied is greater at the active zone, i.e. when the latch is close to closure. As with the previous embodiment, the shape of the slots 699 may be altered to change the path of motion of the latch member 614.

In further embodiments of the invention (not shown) one or more of the above second, third, fourth, fifth, sixth or seventh embodiments are incorporated into a latch assembly as described in the first embodiment of the invention.

Figure 19:
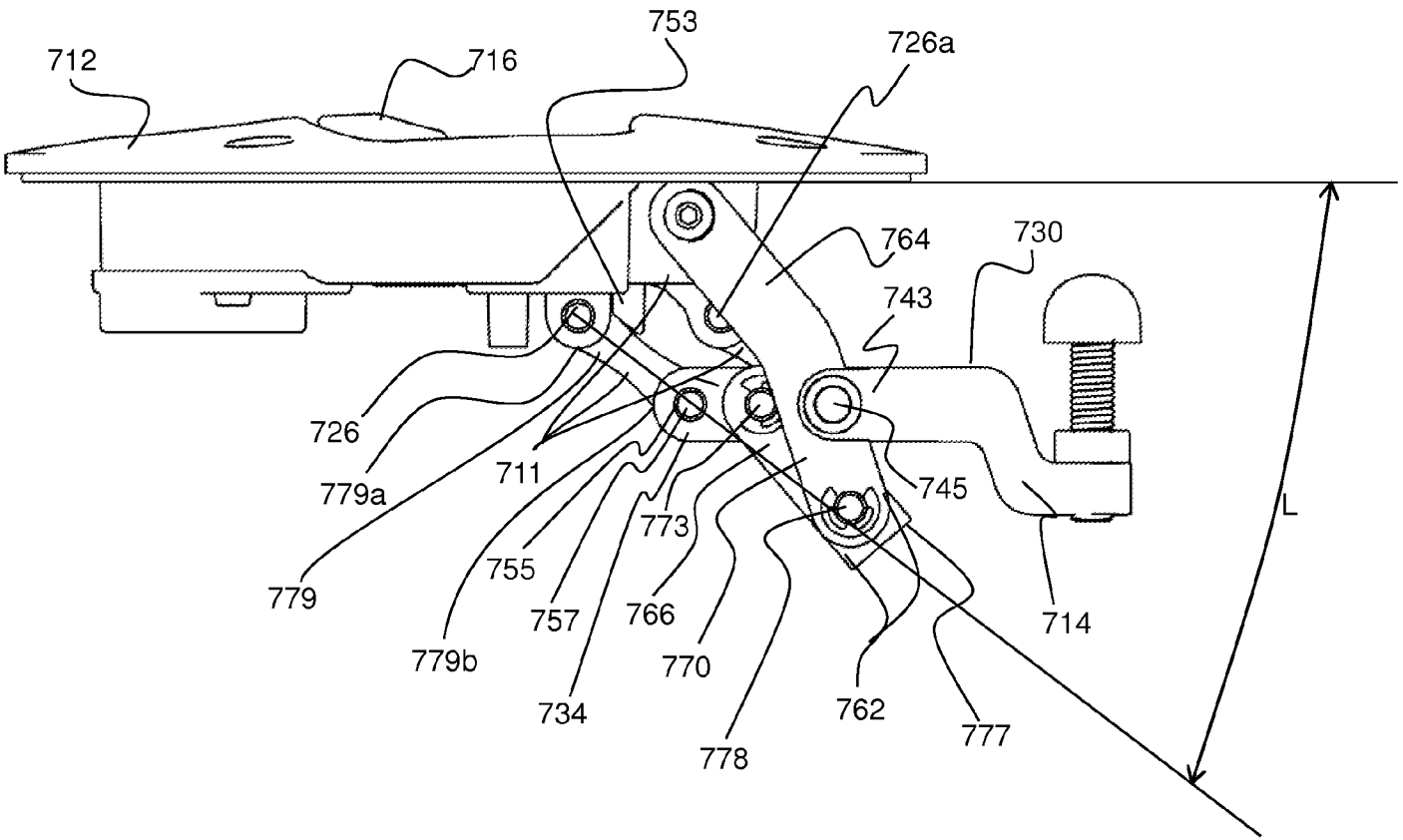
FIG. 19 is a side view of a compression latch according to an eighth embodiment of the present invention in a closed position.
Figure 20:
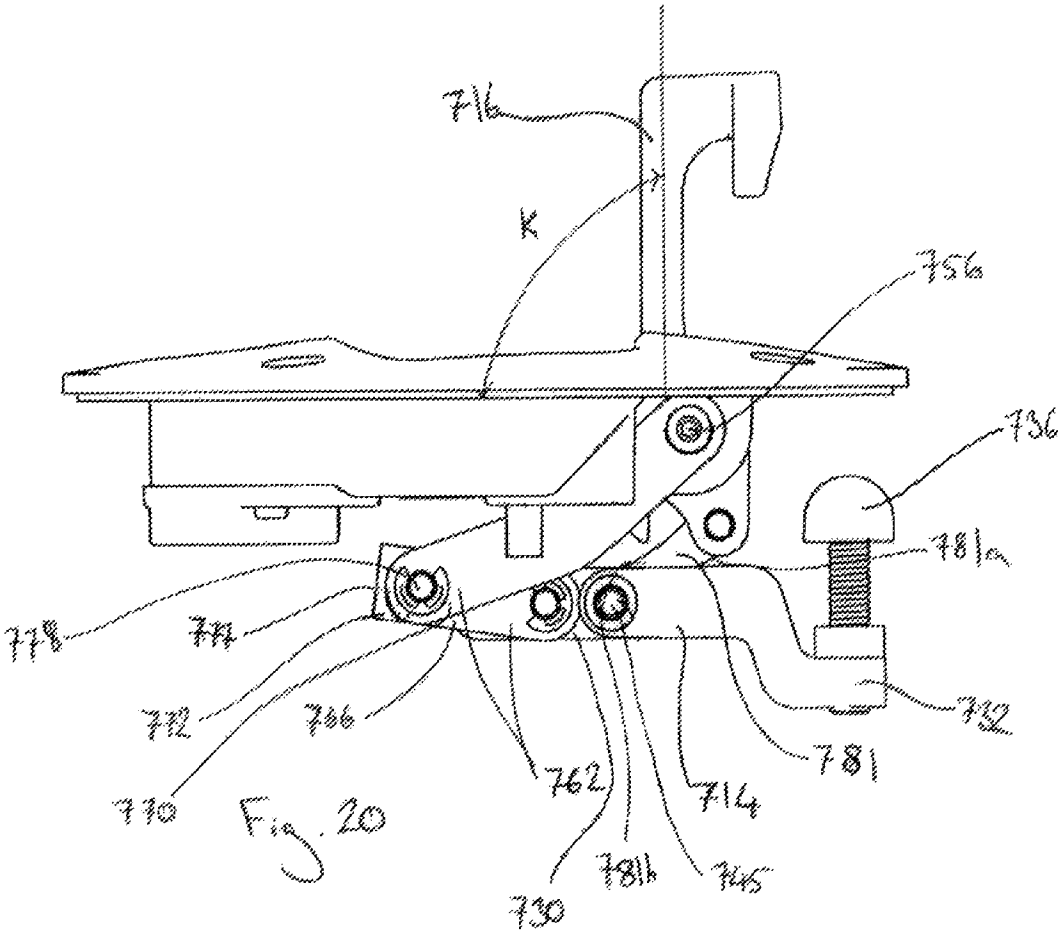
FIG. 20 is a side view of a compression latch according to the embodiment of FIG. 19 in a fully open position.
Figure 21:
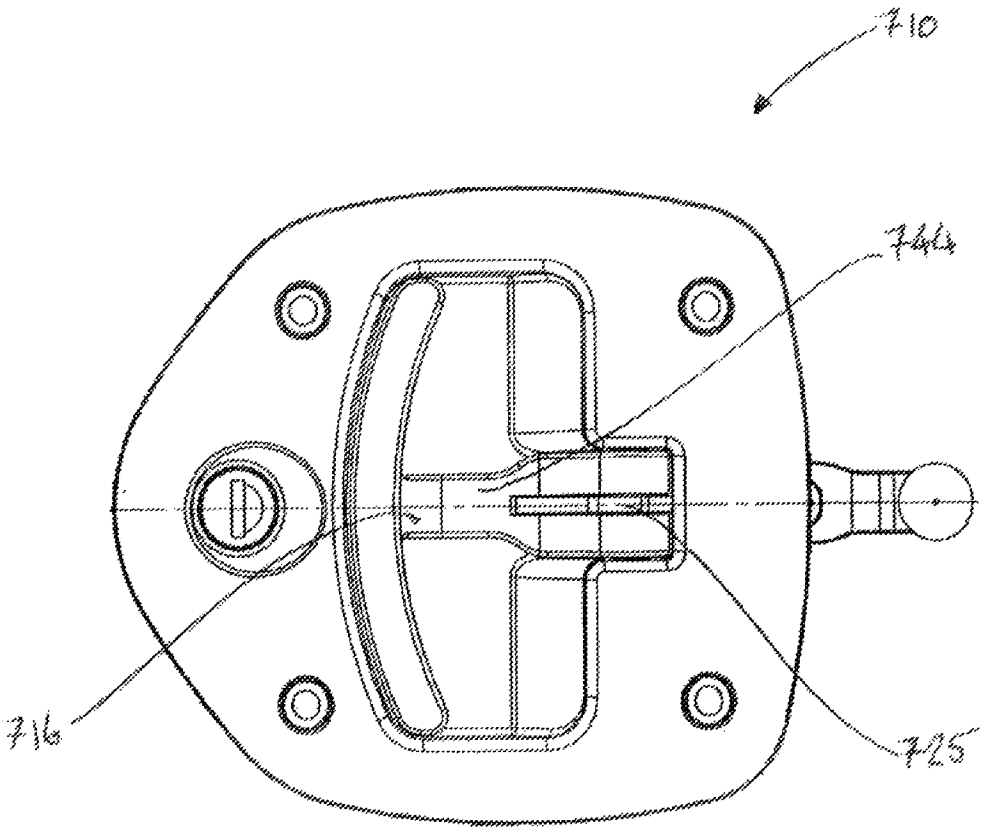
FIG. 21 is a plan view of a compression latch according to the embodiment of FIGS. 19 and 20.

An eighth embodiment of the invention is shown in FIGS. 19, 20 and 21. Features corresponding to those of the previous embodiments have been given corresponding reference numbers with the additional prefix "7". Only features that differ from those of the first embodiment are discussed in depth.

The latch 710 of the seventh embodiment of the invention has a linkage 762 where the first link second ends 770 extend over the latch arm 730 when the latch 710 is in the closed position (e.g. as shown in FIG. 19). That is, the linkage pivot point 778 is inboard of the latch arm 710 when the latch 710 is in the closed position. The first links 764 are bent at a slight angle. The first links 764 are at an angle of approximately 70° to the housing 712 when the latch 710 is in the closed position, and at an angle of approximately 120° to the housing 712 when the latch 710 is in the open position.

The second links 766 of this embodiment are connected to form a U-shape, with the arms of the U providing the second links 766 which are joined by the cross-bar 777 of the U. The first ends 772 of the second links 766 are proximal the cross-bar 777. When the latch 710 is moved from the closed position to the open position (as shown in FIG. 20) the second links 766 are pivoted so that the cross-bar 777 passes over the latch member connection end 734.

In this embodiment, the length of each first link 764 between the handle pivot point 756 and the linkage pivot point 778 is 51.5 mm. The length of each second link 766 between the second link pivot point 773 and the linkage pivot point 778 is in this embodiment 21 mm. These distances may be varied in alternative embodiments.

Over-centre motion of the linkage 762 is required for the latch 710 to move between the fully open and closed positions, which hinders forcing of the latch. Applying force to the handle 716 when the latch 710 is in the closed position causes the second links 766 to act against rotation of the first links 764, so helping to prevent opening of the latch 710.

The latch member 714 of this embodiment is pivotably connected to the housing 712 by a second linkage in the form of first 779 and second 781 connection members arranged to form a parallelogram linkage 711 with the housing 712 and the latch member 714. The connection members 779, 781 are pivotably connected to the housing 712 at one end, and pivotably connected to the latch member 714 at another end, such that the latch member 714 is pivotable with respect to the housing 712. "Pivotable" in this case includes pivotable motion between the latch member 714 and the housing 712 even where relative angles between the two do not substantially change.

The first connection member 779 is pivotably connected to the latch member mounting point 726 at its first end 779*a*, and is pivotably connected at its second end 779*b* to the connection end 734 of the latch member 714 at a mounting point 755. The second connection member 781 is pivotably connected to the housing 712 at a mounting point 726*a* at its first end 781*a*, and is pivotably connected at its second end 781*b* to a mounting point (not shown) on the latch member 714 between the striker end 732 and the second link pivot point 773.

In this embodiment, distances between pivot points are as follows. The distance between the latch member mounting point 726 and mounting point 755, i.e. the length of the first connection member 779 between its pivot points, is 22 mm. The second connection member 781 is of the same length, i.e. the distance between the mounting point 726*a* and the second connection member mounting point on the latch member 714 is 22 mm. In alternative embodiments the connection members 779, 781 may be of different lengths.

The distance between the latch member mounting point 726 and the second connection member mounting point 726*a* in a direction substantially parallel to the plane of the housing 712 is also 22 mm. The distance between the first connection member mounting point 755 and the second connection member mounting point along the latch member 714 is again 22 mm. Again, these distances may be varied in alternative embodiments.

The latch member 714 of this embodiment defines a central longitudinal aperture (not shown) configured to receive the connection member second ends 779*b*, 781*b* at their respective mounting points. Each of the connection member second ends 779*b*, 781*b* defines an aperture (not shown) through which a shaft 757 extends in an interference fit. The ends of each shaft 757 are pivotably received in the connection member second end 779*b*, 781*b* mounting points.

The latch member 714 and connection members 779, 781 of this embodiment are of zinc alloy. The first and second links 764, 766 are of stainless steel. In other embodiments other suitable materials may be used.

The housing 712 of this embodiment has a stop 753 for the first connection member 779. The stop 753 is in the form of a projection adjacent the latch member mounting point 726, and is configured to prevent movement of the first connection member 779 beyond the closed position. The stop 753, through limiting movement of the first connection member 779, prevents movement of the latch member 714 beyond the closed position. In alternative embodiments, a stop may be provided for the second connection member 781 as well as or instead of for the first connection member 779. The connection members 779, 781 may have projections configured to contact the housing 712, or rotation of the shafts 757 may be limited by stops on the latch member 714, to limit movement of the connection members 779, 781.

When the handle 716 is operated to move the latch 710 from a closed to an open position, the latch member 714 is moved by the linkage 762 on the connection members 779, 781 towards the closed position. The connection members 779, 781 pivot about their respective mounting points 726, 726*a* and the latch member 714 describes a shallow arc as it moves from the open to the closed position. The connection members 779, 781 act to retain the latch member 714 relatively parallel to the housing 712 as it moves, so that protrusion of the striker end 732 inboard of the housing is advantageously restricted. The lengths and relative positions of the connection members 779, 781 can be altered to change the path of motion of the latch member 714.

When the latch member 714 reaches the closed position its movement is restricted by contact between the first connection member 779 and the stop 753, and/or between the striker 736 and the closure. The linkage 762 continues to be moved, after the latch member 714 has stopped, into an over-centre position, with the link pivot point 778 between the second link pivot point 773 and the striker 736 in a direction substantially parallel to the plane of the housing 712. Resistance to movement of the latch member 714 is required for the linkage 762 to be moved into the over-centre position. The stop 753 provides this resistance regardless of whether the latch member 714 reaches the closure. Correct fitting of the latch 710 need not, therefore, be relied upon for proper closing of the latch 710. Fluctuations in temperature that could affect the relationship between the latch 710 and the closure are also thus provided for.

The handle 716 moves a greater angular distance in relation to the housing 712 than the first and second connection members 779, 781, so a force advantage is gained, and less force need be applied at the handle 716 than is required at the striker 736. As in earlier embodiments, the compressive force applied is greater at the active zone, i.e. when the latch 710 is close to closure.

The relative angles K, L (see FIGS. 19 and 20) of the handle 716 and connection members 779, 781 to the plane of the housing 712 during closing of the latch 710 are shown in the table below, along with the angular compression ratio at certain intervals.

| Relative angle ° | | |
|---|---|---|
| Handle | Connection members | Compression ratio |
| 0 | 0 | — |
| 1 | 0 | — |
| 2 | 0.1 | 20.00 |
| 3 | 0.3 | 10.00 |
| 4 | 0.5 | 8.00 |
| 5 | 0.9 | 5.56 |
| 10 | 3.2 | 3.13 |
| 15 | 6.7 | 2.24 |

In this embodiment the "active zone" starts when the connection members 779, 781 are at 41.3° to the plane of the housing 712. The connection members 779, 781 move through only 6.7° in the active zone to their datum of 34.6°, whilst the handle 716 moves through 15° to effect movement of the connection members 779, 781. The angular compression ratio at the active zone is therefore 15/6.7, i.e. 2.24. That is, the amount of force applied at the striker 736 to the closure is 2.24 times the force applied by the user to the free end 746 of the handle 716, assuming that the length between the free end 746 and the handle pivot point 756 is equal to length of each connection member 779, 781 between their respective pivot points. Where the handle 716 is longer than the connection members 779, 781, the amount of force applied at the striker 736 to the closure is proportionally greater than 2.24, and vice versa.

As shown in FIG. 21, the padlock loop 725 of this embodiment extends through an aperture defined therefor by the handle arm 744 when the latch 710 is in the closed position. This provides a compact and aesthetically pleasing arrangement for locking the handle 716 in the closed position.

Figure 22:
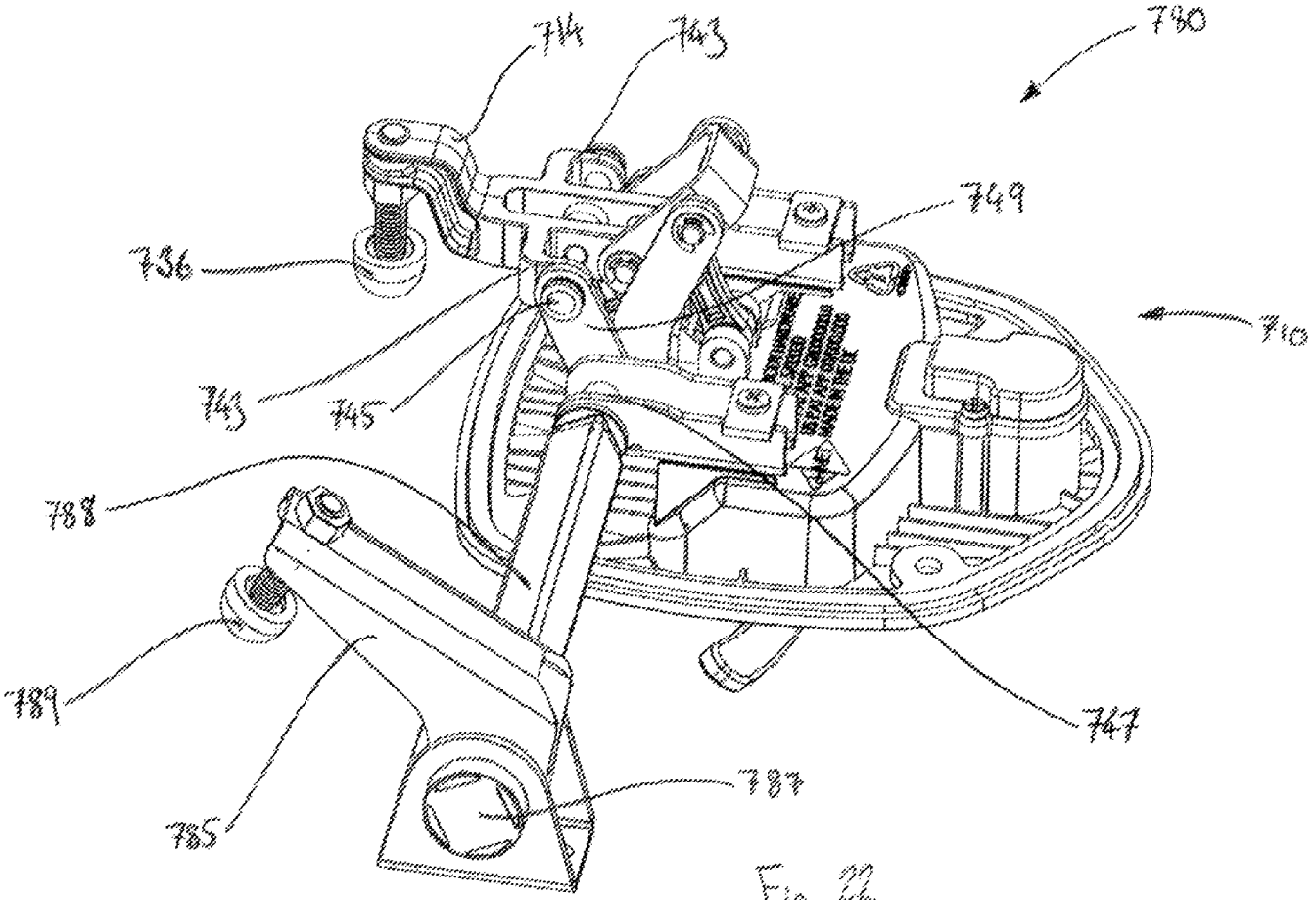
FIG. 22 is a perspective view of a latch assembly incorporating the compression latch according to the embodiment of FIGS. 19 to 21.

The latch 710 is shown in FIG. 22 as part of a latch assembly 780. As with the latch assembly 80 of FIG. 6, the latch assembly 780 includes a second latch member 785 parallel to and configured to turn with the latch member 714. The second latch member 785 is pivotably mounted to a closure (not shown) to which the latch 710 is attached at a mounting point 787 by means of a second latch member shaft (not shown). An extension shaft 788 connects the second latch member shaft to a mounting point 747 proximal the latch 710.

The latch member 714 comprises in this embodiment a pair of arms 743 extending parallel to the main body of the latch member 714. Each arm 743 provides a mounting point 745 for a link 749. In this embodiment, a link 749 extends between the mounting point 745 proximal the second latch member 785 and the extension shaft mounting point 747, and is connected to the extension shaft 788 at the extension shaft mounting point 747. The link 749 is configured to pivot about the extension shaft mounting point 747 and is controlled by movement of the latch member arm 743, so that as the latch member 714 moves between the open and closed positions the link 749 is pivoted at the same rate.

As the link 749 is pivoted about the extension shaft mounting point 747 by the latch member 714, the extension shaft 788 is turned by the link 749, causing the second latch member 785 to turn also. The second latch member 785 is thus pivoted in synchronisation with the latch member 714 between the open and closed positions such that the striker 789 applies pressure to the closure simultaneously to the striker 736. The extension shaft 788 is remote from the closure, preventing damage being caused to the extension shaft 788 and the closure during pivoting of the latch member 785.

In alternative embodiments further latch members may be provided, including a latch member or members perpendicular to the first and second latch members, as shown in FIGS. 6 and 22.

In yet further embodiments of the invention (not shown), the crank of the lever arm may be increased or decreased. The latch may be attached to a closure surround, rather than to a closure. Electronic locking of the latch may be used.

All of the above embodiments of the invention have the advantage of increased independence of motion between the handle and the latch member in comparison to a latch such as that shown in GB2264530. A further advantage of the invention is the distance between the latch member pivot point and the plane of the housing that can be provided by the independence of motion. This is particularly advantageous where a closure has a lip or other projection to be passed, such as that shown in FIG. 6—moving the latch member pivot point inboard removes the need to design the latch arm to pass over such a lip. Distance between the latch member pivot point and the plane of the housing also reduces rubbing of the striker along the closure surround during closure.

Further advantages include that the inboard and outboard ("dry" and "wet") sides of the latch 10 are easily sealed from one another. Simple O-rings are all that are required for sealing of the inboard side.

The invention claimed is:

1. A compression latch for a closure, said compression latch comprising:

a housing;

a handle; and a latch member having a first end and a second end, wherein:

the housing has an inboard side and an outboard side, and defines a plane substantially parallel to a plane of said closure;

the handle is pivotably connected to the housing at a handle pivot point, the handle pivot point having a longitudinal axis substantially parallel to said plane;

the latch member first end is pivotably connected to the housing through a latch member pivot point remote from the handle pivot point and inboard thereof, the latch member pivot point having a longitudinal axis substantially parallel to the handle pivot point longitudinal axis;

the latch member being pivotable about the latch member pivot point between an open position and a closed position;

the handle is connected to the latch member by a first linkage such that the latch member is moveable between said open position and said closed position by angular movement of the handle about the handle pivot point;

the latch member comprises a striker at its second end;

the latch member is pivotably connected to the housing by a second linkage;

the second linkage comprises first and second connection members pivotably connected between the latch member and the housing; and the first and second connection members form a parallelogram linkage with the housing and the latch member, wherein motion of the parallelogram linkage is controlled by the first linkage.

2. A compression latch according to claim 1 wherein one of:

the handle pivot point is on the outboard side of the housing.

3. A compression latch according to claim 1 wherein:

the inboard side of the housing is configured to be sealed from the outboard side of the housing;

the handle pivot point includes a handle shaft extending between the inboard and outboard sides of the housing; and the first linkage is connected to the handle shaft.

4. A compression latch according to claim 1 wherein the first linkage is configured such that angular movement of the handle about the handle pivot point results in smaller angular movement of the latch member at at least one position throughout its range of motion.

5. A compression latch according to claim 4 wherein:

the latch member moves through at least two zones, including an active zone adjacent the closed position, between the closed position and the open position;

the ratio of the angular movement of the handle is greater in the active zone compared to outside the active zone.

6. A compression latch according to claim 1 wherein the ratio of the angular movement of the handle to that of the latch member varies depending upon the angular position of the latch member.

7. A compression latch according to claim 1 wherein the first linkage retains the latch member in a lost motion arrangement such that movement of the latch member towards the open position is controlled by the first linkage.

8. A compression latch according to claim 1 wherein the first linkage is at least a four-bar linkage.

9. A compression latch according to claim 1 wherein:

the first linkage comprises a first link pivotably connected to the handle pivot point and a second link pivotably connected to the first link at a linkage pivot point and pivotably connected to the latch member at a second link pivot point;

the linkage pivot point is inboard relative to the latch member; and the first linkage uses over-centre motion to move between the closed position and an open position.

10. A compression latch according to claim 1 wherein the latch member pivot point is inboard of the handle pivot point.

11. A compression latch according to claim 1 wherein:

the latch member is cranked away from the housing when in the closed position; and the striker is adjustable.

12. A compression latch according to claim 1 and further comprising:

a latching mechanism configured to retain the latch when the latch member is in the closed position; and a lock.

13. A compression latch according to claim 1 and further comprising a padlock loop, wherein:

the handle defines an aperture; and the padlock loop extends through the aperture when the latch member is in the closed position.

14. A compression latch according to claim 1 wherein the latch member pivot point includes a non-circular projection.

15. A compression latch according to claim 1 wherein the latch member pivot point is on the inboard side of the housing.

16. A compression latch for a closure, said compression latch comprising:

a housing;

a handle; and a latch member having a first end and a second end, wherein:

the housing has an inboard side and an outboard side, and defines a plane substantially parallel to a plane of said closure;

the handle is pivotably connected to the housing at a handle pivot point, the handle pivot point having a longitudinal axis substantially parallel to said plane;

the handle is connected to the latch member by a first linkage;

the latch member first end is pivotably connected to the housing by a second linkage;

the latch member being movable in relation to the housing between an open position and a closed position;

such that the latch member is moveable between said open position and said closed position by angular movement of the handle about the handle pivot point;

the latch member comprises a striker at its second end;

the second linkage comprises first and second connection members pivotably connected between the latch member and the housing; and the first and second connection members form a parallelogram linkage with the housing and the latch member, wherein motion of the parallelogram linkage is controlled by the first linkage.

17. A compression latch assembly comprising:

a compression latch for a closure, the compression latch comprising a housing, a handle and a latch member having a first end and a second end;

an extension shaft arranged to rotate with the latch member; and at least one additional latch member, wherein:

the housing has an inboard side and an outboard side, and defines a plane substantially parallel to a plane of said closure;

the handle is pivotably connected to the housing at a handle pivot point, the handle pivot point having a longitudinal axis substantially parallel to said plane;

the latch member first end is pivotably connected to the housing through a latch member pivot point remote from the handle pivot point and inboard thereof, the latch member pivot point having a longitudinal axis substantially parallel to the handle pivot point longitudinal axis;

the latch member being pivotable about the latch member pivot point between an open position and a closed position;

the handle is connected to the latch member by a first linkage such that the latch member is moveable between said open position and said closed position by angular movement of the handle about the handle pivot point;

the latch member is pivotably connected to the housing by a second linkage;

the second linkage comprises first and second connection members pivotably connected between the latch member and the housing; and the first and second connection members form a parallelogram linkage with the housing and the latch member, wherein motion of the parallelogram linkage is controlled by the first linkage;

the latch member comprises a striker at its second end, the at least one additional latch member is pivotable about a pivot point remote to the latch member pivot point, the latch member pivot point comprises a non-circular projection configured for the attachment of said extension shaft, and said extension shaft extends between the latch member pivot point and the at least one additional latch member, such that the at least one additional latch member is actuated by movement of the latch member of the compression latch.

* * * * *